US010626667B2

(12) United States Patent
Schulman

(10) Patent No.: US 10,626,667 B2
(45) Date of Patent: Apr. 21, 2020

(54) WINDOW SYSTEM COVERING AND OPERATING SYSTEM

(71) Applicant: Hunter Douglas Industries Switzerland GmbH, Lucerne (CH)

(72) Inventor: Michael Jay Schulman, Atlanta, GA (US)

(73) Assignee: Hunter Dougls Industries Switzerland GmbH, Lucerne (CH)

( * ) Notice: Subject to any disclaimer, the term of this patent is extended or adjusted under 35 U.S.C. 154(b) by 319 days.

(21) Appl. No.: 15/456,724

(22) Filed: Mar. 13, 2017

(65) Prior Publication Data

US 2017/0183904 A1 Jun. 29, 2017

Related U.S. Application Data

(62) Division of application No. 14/612,529, filed on Feb. 3, 2015, now abandoned.

(51) Int. Cl.
*E06B 9/322* (2006.01)
*E06B 9/326* (2006.01)
(Continued)

(52) U.S. Cl.
CPC ..... *E06B 9/322* (2013.01); *E06B 9/326* (2013.01); *E06B 9/68* (2013.01); *E06B 9/32* (2013.01);
(Continued)

(58) Field of Classification Search
CPC ... E06B 9/322; E06B 9/68; E06B 9/32; E06B 9/56; E06B 9/84; E06B 9/80;
(Continued)

(56) References Cited

U.S. PATENT DOCUMENTS 227,146 A * 5/1880 Campbell ..... E06B 9/90 160/304.1
274,049 A * 3/1883 Sweetland ..... E06B 9/90 160/304.1
(Continued)

FOREIGN PATENT DOCUMENTS

DE 19505824 8/1996
EP 1748144 1/2007

OTHER PUBLICATIONS

Newell Window Furnishings, Inc. International Application No. PCT/US2013/50080, International Search Report and Written Opinion, dated Nov. 22, 2013.
(Continued)

*Primary Examiner* — Johnnie A. Shablack
(74) *Attorney, Agent, or Firm* — Dority & Manning, P.A.

(57) ABSTRACT

A window covering includes a head rail that supports a panel by lift cords such that one end of the panel may be raised and lowered relative to the head rail. An operating system controls movement of the panel and includes spools coupled to the lift cords such that rotation of the spools retracts and extends the lift cords. A shaft is connected to a spool of the lift spool assembly and to a brake and a spring motor. The spring motor applies a motor force to the shaft and the brake applies a brake force to the shaft such that the forces generated by the spring motor and brake hold the panel in the desired position.

25 Claims, 16 Drawing Sheets

(51) Int. Cl.
*E06B 9/68* (2006.01)
*E06B 9/32* (2006.01)
*E06B 9/56* (2006.01)
*E06B 9/28* (2006.01)

(52) U.S. Cl.
CPC ..... *E06B 9/56* (2013.01); *E06B 2009/285* (2013.01); *E06B 2009/3222* (2013.01); *E06B 2009/3225* (2013.01)

(58) Field of Classification Search
CPC ..... E06B 2009/285; E06B 2009/3222; E06B 2009/3225; E06B 2009/807
USPC ..... 160/168.1 P, 173 R, 176.1 P, 177 R, 160/178.1 R, 291, 294, 298, 299, 300, 160/301, 304.1
See application file for complete search history.

(56) References Cited

U.S. PATENT DOCUMENTS 280,249 A * 6/1883 Shaw ..... E06B 9/90 160/292
291,502 A * 1/1884 Finch ..... E06B 9/90 160/296
300,841 A * 6/1884 Briggs ..... E06B 9/90 160/304.1
301,771 A * 7/1884 Sturgeon ..... E06B 9/90 160/304.1
1,010,574 A * 12/1911 Bird ..... B66D 3/14 192/16
1,344,358 A * 6/1920 Simpson ..... E06B 9/90 160/268.1
1,378,347 A * 5/1921 Hart ..... E06B 9/90 160/304.1
1,407,991 A * 2/1922 Digney ..... E06B 9/90 160/304.1
1,464,412 A * 8/1923 Dillon ..... E06B 9/82 160/244
1,513,499 A * 10/1924 Goodman ..... E06B 9/90 160/304.1
1,566,248 A * 12/1925 Hendricks ..... E06B 9/90 160/304.1
2,031,473 A * 2/1936 Fay ..... E06B 9/90 160/296
2,119,550 A * 6/1938 Loughridge ..... E06B 3/90 188/134
2,134,405 A * 10/1938 Hulshizer ..... E21B 19/081 173/156
2,570,140 A * 10/1951 Mayer, Jr. ..... E06B 9/90 160/304.1
2,663,368 A 12/1953 Walker
2,701,611 A 2/1955 Griesser
3,115,927 A * 12/1963 Znamirowski ..... E06B 9/60 160/301
3,180,400 A 4/1965 Rau
3,194,343 A * 7/1965 Sindlinger ..... F03G 1/00 185/10
3,289,739 A 12/1966 Hensel
3,352,349 A 11/1967 Hennequin
3,404,504 A 10/1968 Taylor
3,637,004 A * 1/1972 Wardlaw ..... E06B 9/68 160/133
3,870,096 A * 3/1975 Horrell ..... B60P 3/343 160/305
4,042,075 A * 8/1977 Hehl ..... E06B 9/60 160/298
4,188,992 A * 2/1980 Segerljung ..... E06B 9/82 160/296
4,200,135 A 4/1980 Hennequin
4,346,749 A * 8/1982 Singletary ..... E06B 9/90 160/301
4,372,432 A 2/1983 Waine et al.
4,498,517 A * 2/1985 Mase ..... E06B 9/82 160/294
4,513,805 A * 4/1985 Mase ..... E06B 9/80 160/299
4,662,423 A * 5/1987 Ishii ..... E06B 9/90 160/293.1
4,697,630 A 10/1987 Rude
4,705,148 A * 11/1987 Zindler ..... E04F 10/0614 160/298
4,834,220 A * 5/1989 Nowak ..... B23Q 5/56 188/77 R
5,154,558 A 10/1992 McCallion
5,167,269 A * 12/1992 Abo ..... E06B 9/90 160/305
5,228,491 A 7/1993 Rude et al.
5,328,113 A 7/1994 De Chevron Villette et al.
5,375,643 A 12/1994 Rude
5,482,100 A 1/1996 Kuhar
5,531,257 A * 7/1996 Kuhar ..... E06B 9/32 160/168.1 P
5,725,040 A 3/1998 Domel
5,799,342 A * 9/1998 Last ..... E04H 4/101 4/502
5,908,062 A 6/1999 Fun
5,927,370 A 7/1999 Judkins
6,012,506 A 1/2000 Wang et al.
6,056,036 A * 5/2000 Todd ..... E06B 9/262 160/84.01
6,116,323 A 9/2000 Huang
6,131,642 A * 10/2000 Welfonder ..... E06B 9/90 160/301
6,149,094 A 11/2000 Martin et al.
6,530,863 B2 * 3/2003 Balli ..... E06B 9/74 160/310
6,536,503 B1 3/2003 Anderson et al.
6,571,853 B1 6/2003 Ciuca et al.
6,601,635 B2 * 8/2003 Ciuca ..... E06B 9/32 160/170
6,644,375 B2 * 11/2003 Palmer ..... E06B 9/322 160/170
6,675,861 B2 * 1/2004 Palmer ..... E06B 9/322 160/170
6,718,707 B2 4/2004 Marshall
6,792,997 B2 9/2004 Damiano
6,915,831 B2 7/2005 Anderson
6,945,302 B2 9/2005 Nien
6,948,216 B2 9/2005 Gaudyn et al.
6,968,884 B2 11/2005 Anderson et al.
6,986,378 B2 * 1/2006 Beaudoin ..... E05D 13/003 160/191
7,096,917 B2 * 8/2006 Ciuca ..... E06B 9/322 160/170
7,108,037 B1 * 9/2006 Ebeling ..... E04F 10/0666 160/298
7,137,430 B2 11/2006 Fraczek
7,168,476 B2 * 1/2007 Chen ..... E06B 9/322 160/170
7,178,577 B2 2/2007 Liu
7,210,646 B2 5/2007 Hsu
7,254,868 B2 * 8/2007 Mullet ..... E05D 13/003 16/198
7,287,569 B2 10/2007 Lin
7,311,133 B2 12/2007 Anderson et al.
7,389,956 B2 6/2008 Hung
7,428,918 B2 * 9/2008 Martin ..... E05D 13/003 160/191
7,540,315 B2 6/2009 Chen
7,543,625 B2 * 6/2009 Beaudoin ..... E05D 13/1269 160/191
7,614,486 B2 11/2009 Bird et al.
7,740,045 B2 6/2010 Anderson et al.
7,802,608 B2 * 9/2010 Anderson ..... E06B 9/262 160/170
7,832,450 B2 11/2010 Brace et al.
7,832,453 B2 11/2010 Lin
7,886,803 B2 2/2011 Anderson et al.
8,006,735 B2 8/2011 Collum et al.

(56) References Cited

U.S. PATENT DOCUMENTS

| | | | | |
|---|---|---|---|---|
| 8,051,960 | B2 | 11/2011 | Nakajima | |
| 8,356,653 | B2 | 1/2013 | Fu-Lai et al. | |
| 8,622,184 | B2 | 1/2014 | Sakai et al. | |
| 8,723,466 | B2 | 5/2014 | Chambers et al. | |
| 8,887,788 | B2 * | 11/2014 | Toti | E06B 9/322 160/170 |
| 8,893,766 | B2 * | 11/2014 | Bohlen | E06B 9/88 160/323.1 |
| 8,939,190 | B2 * | 1/2015 | Mullet | E06B 9/307 160/176.1 P |
| 9,103,157 | B2 * | 8/2015 | Mullet | E06B 9/322 |
| 9,217,282 | B2 * | 12/2015 | Defenbaugh | E06B 9/68 |
| 9,217,284 | B2 * | 12/2015 | Panseri | E05D 13/003 |
| 9,663,986 | B2 * | 5/2017 | Mullet | E06B 9/322 |
| 9,670,724 | B2 * | 6/2017 | Oakley | E06B 9/322 |
| 9,677,330 | B2 * | 6/2017 | Anderson | E06B 9/322 |
| 9,695,633 | B2 * | 7/2017 | Morris | E06B 9/262 |
| 9,702,184 | B2 * | 7/2017 | Gilmer | E06B 9/304 |
| 9,732,555 | B2 * | 8/2017 | Morris | E06B 9/322 |
| 9,765,565 | B2 * | 9/2017 | Morris | E06B 9/262 |
| 9,903,158 | B2 * | 2/2018 | Guan | E06B 9/307 |
| 9,957,750 | B2 * | 5/2018 | Lin | E06B 9/262 |
| 9,988,837 | B2 * | 6/2018 | Defenbaugh | E06B 9/322 |
| 2002/0046817 | A1 | 4/2002 | Last | |
| 2003/0221799 | A1 | 12/2003 | Cross et al. | |
| 2004/0177933 | A1 | 9/2004 | Hillman et al. | |
| 2005/0217805 | A1 | 10/2005 | Strand et al. | |
| 2006/0000561 | A1 | 1/2006 | Anderson et al. | |
| 2006/0108076 | A1 | 5/2006 | Huang | |
| 2006/0118248 | A1 | 6/2006 | Anderson et al. | |
| 2007/0023149 | A1 | 2/2007 | Lamars et al. | |
| 2007/0039696 | A1 * | 2/2007 | Strand | E06B 9/262 160/84.04 |
| 2009/0020239 | A1 * | 1/2009 | Yu | E06B 9/322 160/331 |
| 2009/0120592 | A1 * | 5/2009 | Lesperance | E06B 9/322 160/84.02 |
| 2009/0242332 | A1 | 10/2009 | Anderson et al. | |
| 2009/0294076 | A1 | 12/2009 | McNiel | |
| 2010/0206492 | A1 * | 8/2010 | Shevick | E06B 9/30 160/170 |
| 2010/0288451 | A1 * | 11/2010 | Bohlen | E06B 9/88 160/291 |
| 2011/0000628 | A1 * | 1/2011 | Anderson | E06B 9/262 160/313 |
| 2011/0277943 | A1 * | 11/2011 | Lin | E06B 9/262 160/84.04 |
| 2012/0145335 | A1 | 6/2012 | Panseri et al. | |
| 2013/0248125 | A1 * | 9/2013 | Lin | E06B 9/262 160/84.05 |
| 2014/0014279 | A1 | 1/2014 | Defenbaugh et al. | |
| 2014/0083631 | A1 | 3/2014 | Huang | |
| 2014/0262062 | A1 * | 9/2014 | Higgins | E06B 9/42 160/84.01 |
| 2015/0028144 | A1 | 1/2015 | Defenbaugh et al. | |
| 2016/0222722 | A1 * | 8/2016 | Schulman | E06B 9/322 |
| 2016/0369558 | A1 * | 12/2016 | Kirby | E06B 9/80 |
| 2017/0183904 | A1 * | 6/2017 | Schulman | E06B 9/322 |
| 2017/0254143 | A1 * | 9/2017 | Guan | E06B 9/307 |

OTHER PUBLICATIONS

Chinese Office Action issued in corresponding CN Application No. 201810164752, dated Jan. 31, 2019, with English translation (17 pages).

* cited by examiner

WINDOW SYSTEM COVERING AND OPERATING SYSTEM

CROSS-REFERENCE TO RELATED APPLICATIONS

This application is a divisional of and claims the benefit of priority of U.S. patent application Ser. No. 14/612,529, filed on Feb. 3, 2015, the disclosure of which is hereby incorporated by reference herein in its entirety for all purposes.

BACKGROUND

The invention relates to window coverings and more particularly to an operating system for controlling the operation of the window covering. A window covering may comprise a head rail from which a panel is suspended. The head rail may be mounted to a window frame or other architectural feature. The panel may be supported by lift cords to raise and lower the panel relative to the head rail. The raising and lowering of the panel may be controlled using pull cords or the raising and lowering of the panel may comprise a "cordless" system where the panel is raised and lowered by direct manipulation of the panel.

SUMMARY OF THE INVENTION

In some embodiments, a cordless operating system for a window covering comprises at least one spring motor, at least one brake, and at least one lift spool assembly. An effective shaft connects the spring motor, the brake and the lift spool assembly. The brake comprises a race engaged with a brake member where the race is selectively coupled for rotation with the shaft by a pawl on the race that directly engages the shaft.

The outer race may have a generally cylindrical shape that defines a cylindrical brake surface and the brake member may comprise a band brake that is in contact with the brake surface. The race may define an aperture that receives the effective shaft such that the effective shaft extends through the race. The band brake may have a first free end and a second free end where the first free end and the second free end may be movable toward and away from one another. A force control mechanism may move the first free end towards the second free end such that a force applied by the brake member on the race may be controlled by the force control mechanism. A spool having a sloped arcuate receiving end may receive a lift cord and may narrow to an opposite end. The spool may comprise a flange that extends radially from the receiving end and a cover that covers a top portion of the spool where the cover may comprise a recess for receiving the flange. The spring motor may be positionable at any unoccupied location on the effective shaft where the spring motor applies a first force directly to the shaft at a first location along the shaft and the brake applies a brake force directly to the shaft at a second location along the shaft where the first location is spaced from the second location along the longitudinal axis of the shaft. The brake may be located at one end of the effective shaft. A first keyed hole may be formed in the spring motor, a second keyed hole may be formed in the brake, and a third keyed hole may be formed in the lift spool assembly such that the effective shaft may be inserted through the first keyed hole, the second keyed hole, and the third keyed hole. The race may be mounted for rotary motion on an axle where the axle may be mounted for rotation with the shaft. The pawl may be configured such that rotation of the shaft in a first direction locks the pawl to the shaft and rotation of the shaft in a second direction does not lock the pawl to the shaft. The first direction may correspond to a lowering direction of a window covering panel and the second direction may correspond to a raising direction of the panel.

In some embodiments a cordless operating system for a window covering comprises at least one spring motor, at least one brake, and at least one lift spool assembly. An effective shaft connects the spring motor, the brake and the lift spool assembly. The brake comprises a race engaged with a brake member where the race is selectively coupled for rotation with the shaft by at least one movable pin mounted for rotation with the shaft.

The race may be mounted for rotary motion on an axle where the axle is mounted for rotation with the shaft. The pin may be freely movable in the axle for axial translation of the pin transverse to the axis of rotation of the shaft. The race may comprise a cam surface disposed outside of the pin such that the pin may make direct contact with the cam surface. The profile of the cam surface may comprise a ramp surface for moving the pin and an abutment surface engageable with the pin to lock the race for rotation with the shaft. The abutment surface may be disposed generally along radii of the rotating axle. The cam surface may be configured such that rotation of the shaft in a first direction locks the race to the shaft and rotation of the shaft in a second direction does not lock the race to the shaft. The first direction may correspond to a lowering direction of a window covering panel and the second direction may correspond to a raising direction of the panel.

In some embodiments a cordless operating system for a window covering comprises at least one spring motor, at least one brake, and at least one lift spool assembly. An effective shaft connects the spring motor, the brake and the lift spool assembly. The brake comprises a race engaged with a brake member where the race is selectively coupled for rotation with the shaft by sprag clutch mounted for rotation with the shaft.

The sprag clutch may be mounted for rotation with the shaft. The sprag clutch may comprise a hub mounted on the effective shaft and a plurality of sprags formed with and extending from the hub. The sprags may extend at a non-normal angle from the hub. The sprags may comprise generally planar members.

DETAILED DESCRIPTION OF EMBODIMENTS OF THE INVENTION

Embodiments of the present invention will be described more fully hereinafter with reference to the accompanying drawings, in which embodiments of the invention are shown. This invention may, however, be embodied in many different forms and should not be construed as limited to the embodiments set forth herein. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" or "front" or "rear" may be used herein to describe a relationship of one element, area or region to another element, area or region as illustrated in the figures. It will be understood that these terms are intended to encompass different orientations of the device in addition to the orientation depicted in the figures.

Figure 1:
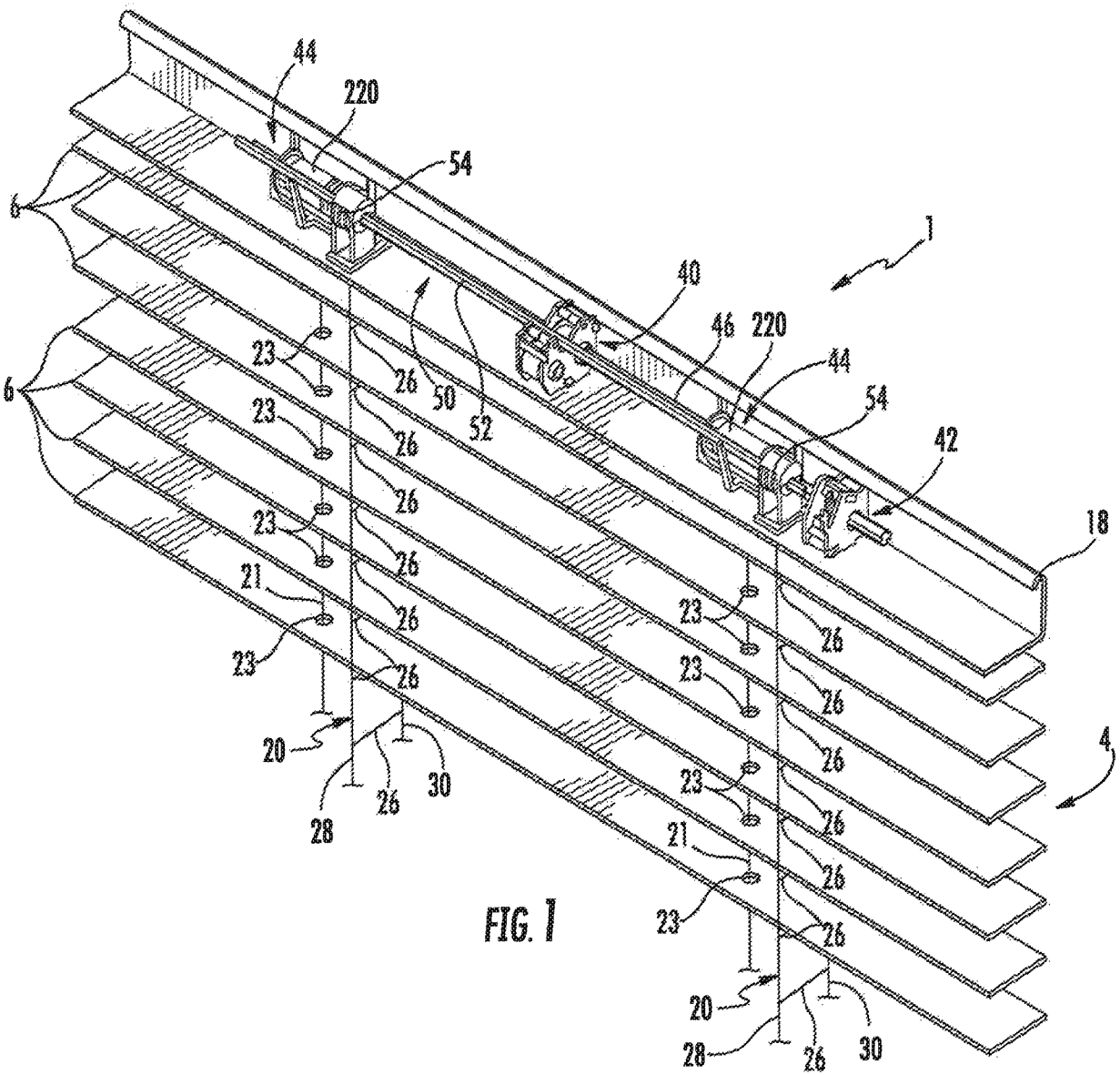
FIG. 1 is a cut-away perspective view of an embodiment of a window covering and operating system of the invention.
Figure 2:
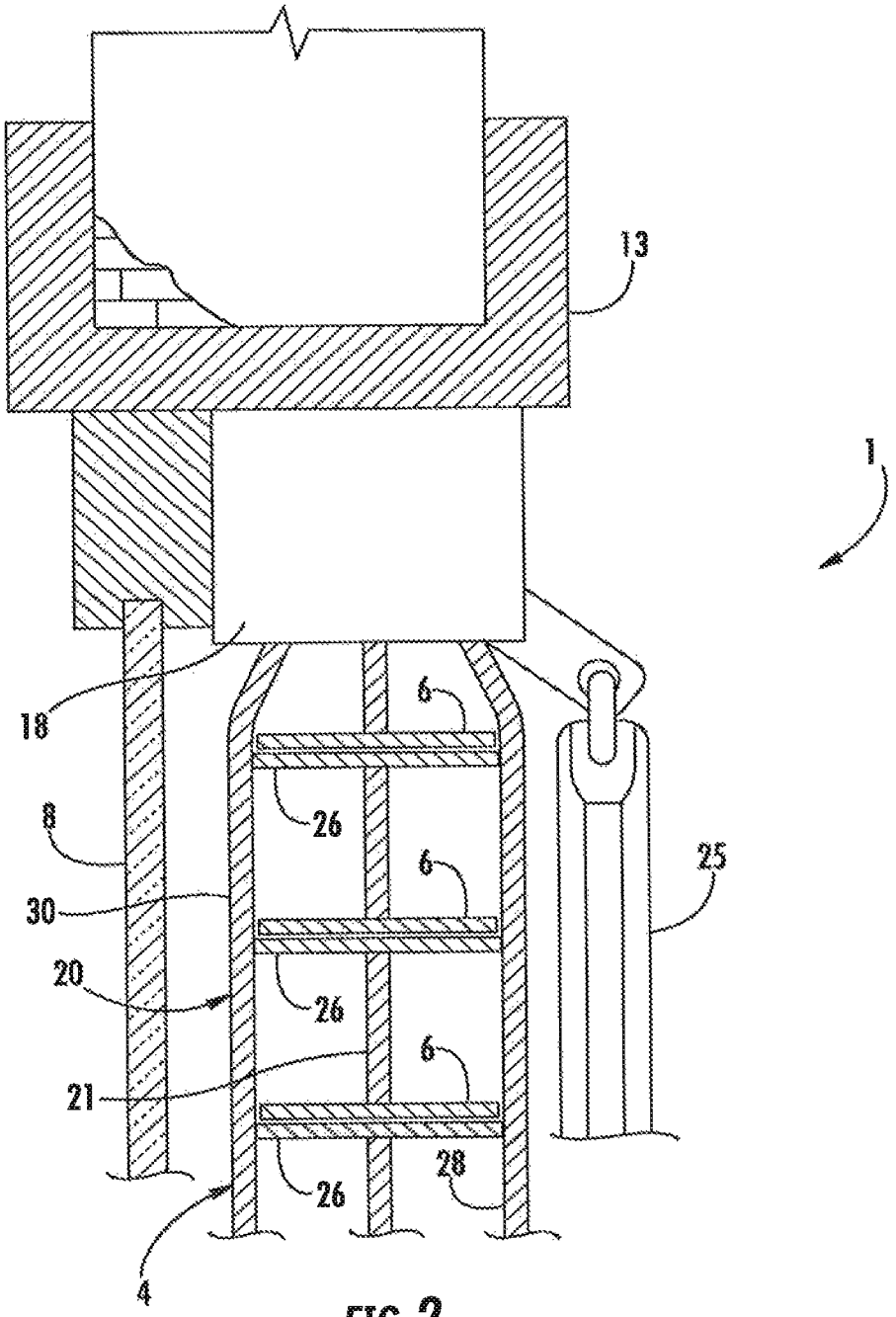
FIG. 2 is a partial side section view of an embodiment of a window covering as used with the operating system of the invention.
Figure 3:
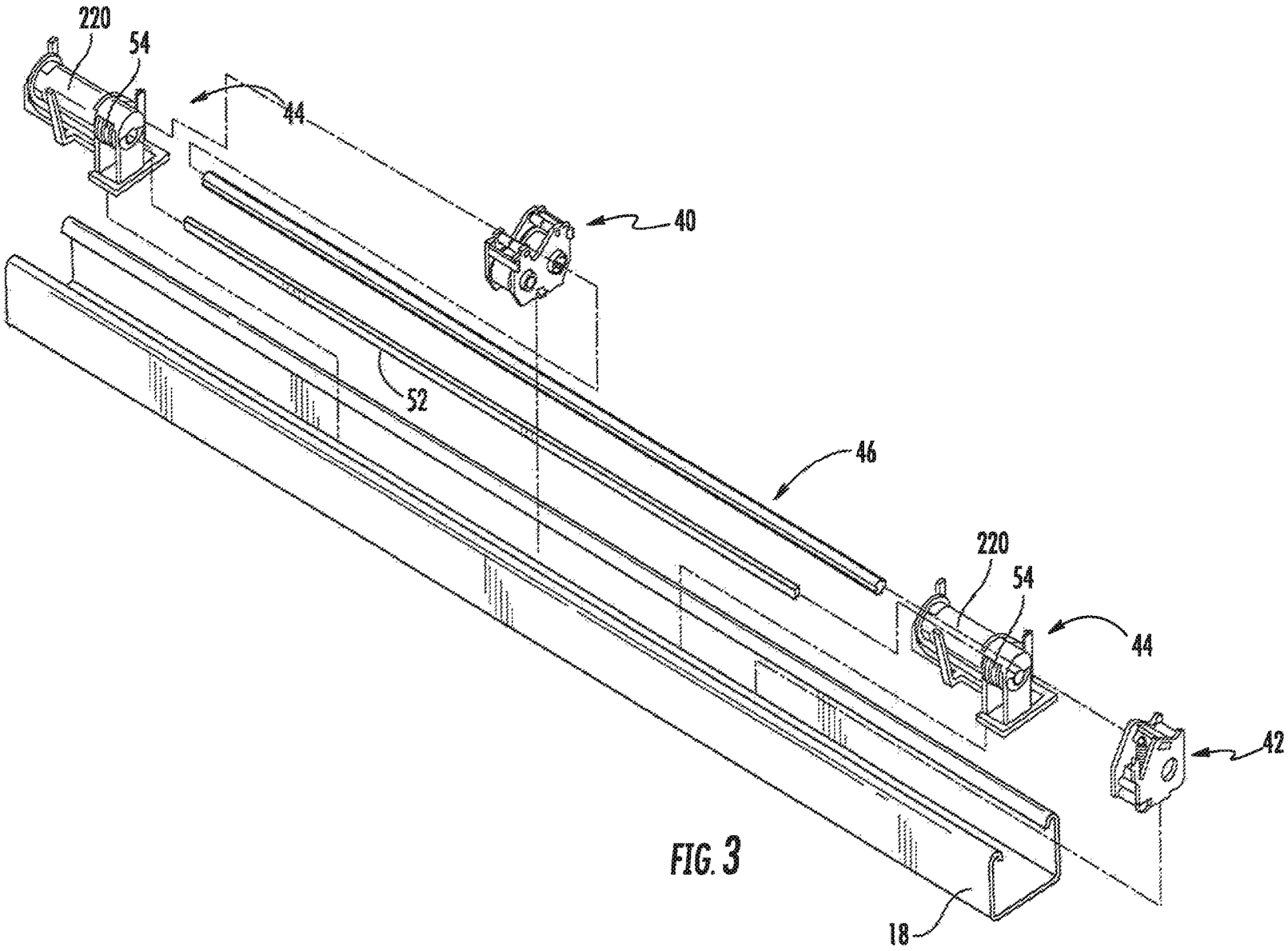
FIG. 3 is an exploded perspective view of the operating system of FIG. 1.

Referring to FIGS. 1 and 2 an embodiment of a window covering 1 is shown comprising a head rail 18 from which a panel 4 is suspended. The panel may comprise a slatted blind, a cellular shade, pleated shade, Roman shade, natural shade or other blind or shade construction or combinations thereof. In the illustrated embodiment panel 4 comprises a slatted blind comprised of a plurality of slats 6. The head rail 18 may be constructed of wood, steel or other rigid material and may be solid or have an interior channel. It is appreciated that, in some embodiments, the term "head rail" need not be limited to a traditional head rail structure and may include any structure, component or components from which a shade may be suspended or supported and which may include the operating system. The head rail 18 may be mounted to a window frame or other architectural feature 13 by brackets or other mounting mechanism to cover the window or other opening 8 (FIG. 2). The panel 4 has a top edge that is located adjacent to the head rail 18 and a bottom edge remote from the head rail 2 that may terminate in a bottom rail (not shown).

The shade panel 4 may be supported by lift cords 21 that are connected to or near the bottom edge of the panel 4 or to the bottom rail. The lift cords 21 may be retracted toward the head rail 18 to raise the shade or extended way from the head rail to lower the shade. The lift cords 21 may be operatively connected to the operating system that may be used to raise and lower the shade panel as will hereinafter be described. In one type of window covering, known as a privacy panel, each lift cord extends down the outside of one side of the panel, around the bottom of the panel and up the outside of the other side of the panel. In another type of window covering the lift cords 21 extend through apertures formed in the shade panel, such as through apertures 23 in slats 6, as shown in FIGS. 1 and 2.

For a slatted blind, the slats 6 are also supported by a tilt cord 20 that functions to tilt the slats 6 between open positions where the slats 6 are spaced from one another and closed positions where the slats 6 are disposed in an abutting, overlapping manner. The tilt cord 20 may comprise a ladder cord as shown that supports the individual slats 6 where manipulation of the ladder cord results in the tilting of the slats 6 between an open position, closed positions and any intermediate position. The tilt cord 20 may be controlled by a user control 25 such as a control wand or cord that is manipulated by the user to adjust the opening and closing of the slats. Each tilt cord 20 may comprise a ladder cord that has a plurality of rungs 26 that are connected to and supported at each end by vertical support cords 28 and 30. A slat 6 rests on top of is otherwise supported by each rung 26. A drum 54 or other control device may be rotated by a user using a control 25 such that the front vertical support cord 28 may be raised or lowered while the back vertical support cord 30 is simultaneously lowered or raised, respectively, to tilt the rungs 26 and the slats 6. Typically, the slats will be supported by two or more tilt cords 20 and two or more lift cords 21 depending upon the width of the window covering. While specific embodiments of a window covering are disclosed, the window covering may have a wide variety of constructions and configurations.

The operating system for controlling movement (raising and lowering) of the panel uses a cordless design where the raising and lowering of the panel is adjusted by manually moving the panel into position and then releasing the panel. There are user benefits for cordless products, for example reducing the risk of hazardous cord loops and providing a cleaner look for the window. Cordless products have inherent challenges over corded products. First, cordless products typically have a greater number of components, as well as more complex components. These factors lead to more complex manufacturing and ultimately higher costs. Second, cordless products typically require a larger headrail to be able to fit all the internal components of the operating system. The challenges of cordless products are more pronounced with opening price point (OPP) window coverings or commodity window coverings that are relatively inexpensive such as, for example, aluminum mini-blinds such as are commonly found in commercial buildings. Also, having a relatively large headrail, for example 2 "depth, for a product that is relatively small, for example 1" slat width mini-blinds, is not aesthetically ideal for the user and in some installations the window frame may not be deep enough to fully seat the headrail.

The cordless operating system, if balanced properly, holds the panel 4 in position without the panel sagging (lowering)

or creeping (rising). The operating system described herein may be used to control the movement of the bottom edge of a traditional panel and/or the top edge of a top down panel. The operating system uses spring motors, take-up spools and brakes to balance the load of the panel such that it may be moved into a desired position without sagging or creeping. It is difficult to balance the load of a window covering panel because the forces exerted by the spring motor, brake and system friction must be balanced against the supported load of the panel where the load of the panel 4 supported by the lift cords 21 varies as the panel is raised and lowered. As a result, cordless window coverings have been limited to expensive blinds where the window covering may be weighted to balance against the forces generated by the spring motor, brake and system friction. The operating system of the invention is an improved cordless operating system that is more easily and effectively balanced and is less expensive than existing systems. As a result, the operating system of the invention may be used with OPP window coverings.

An embodiment of the operating system of the invention comprises at least one spring motor 40, at least one brake 42, at least one lift spool assembly 44 and a shaft 46 interconnecting and synchronizing these components. In a typical use two or more lift spool assemblies 44 are used each supporting a lift cord 21 depending upon the size of the blind. Each spool 220 of lift spool assembly 44 may be connected to the panel 4 by a lift cord 21 that is wound onto and unwound from the spool. In operation, the spring motor or motors 40 apply a force on the shaft 46 that rotates the spools 60 in a direction that winds the lift cords 21 onto the spools 220 and raises the panel 4. According to one embodiment, the force applied by the spring motors 40 can be slightly underpowered relative to the load of the panel such that a raised panel will tend to sag when released due to the weight of the panel. In other embodiments, however, an overpowered motor may be utilized, such that the panel may tend to rise (creep) under the power of the motor when released. Some embodiments, as described in more detail herein, can utilize braking mechanisms to accommodate for any slight differences between the panel load and motor output.

According to one embodiment, the brake 42 may be a one-way brake that applies a braking force on the shaft 46 that resists rotation of the shaft in the lowering direction such that sagging of the window covering is prevented. When a user raises the panel 4, the spring motors 40 wind the lift cords 21 on the spools 220 of the lift spool assemblies 44 and assist the user in raising the panel. When the user releases the panel 4, the brake 42 holds the shaft 46 in the desired position and prevents sagging of the panel. To lower the panel 4, the user pulls down on the bottom of the panel 4 (or on the top of the panel in a top down shade) to overcome the brake force generated by brake 42 and the forces generated by the spring motors 40. However, as described further herein, a one-way brake may be applied in the opposite direction to resist rotation of the shaft in the raising direction to prevent panel creep.

Referring to FIGS. 1, 3 and 15-17, for a slatted blind with tilting slats a tilt system 50 may also be provided. In one embodiment, the tilt system 50 comprises a second shaft 52 supporting at least one tilt drum 54. A tilt assembly in the head rail rotates the shaft 52 when actuated by a user control 25. The tilt assembly may comprise a transmission such as a gear train that transmits rotation of the user control 25 to shaft 52. In typical use two or more tilt drums 54 may be used depending upon the size of the blind. The tilt drums 54 may be connected to the slats by the tilt cords 20 such that rotation of the drums 54 moves the tilt cords to open and close the slats. In the illustrated embodiment the tilt shaft 52 is supported by the housing of the spool assemblies 44; however, the tilt shaft 52 may be supported by structure independent of the lift system.

Figure 4:
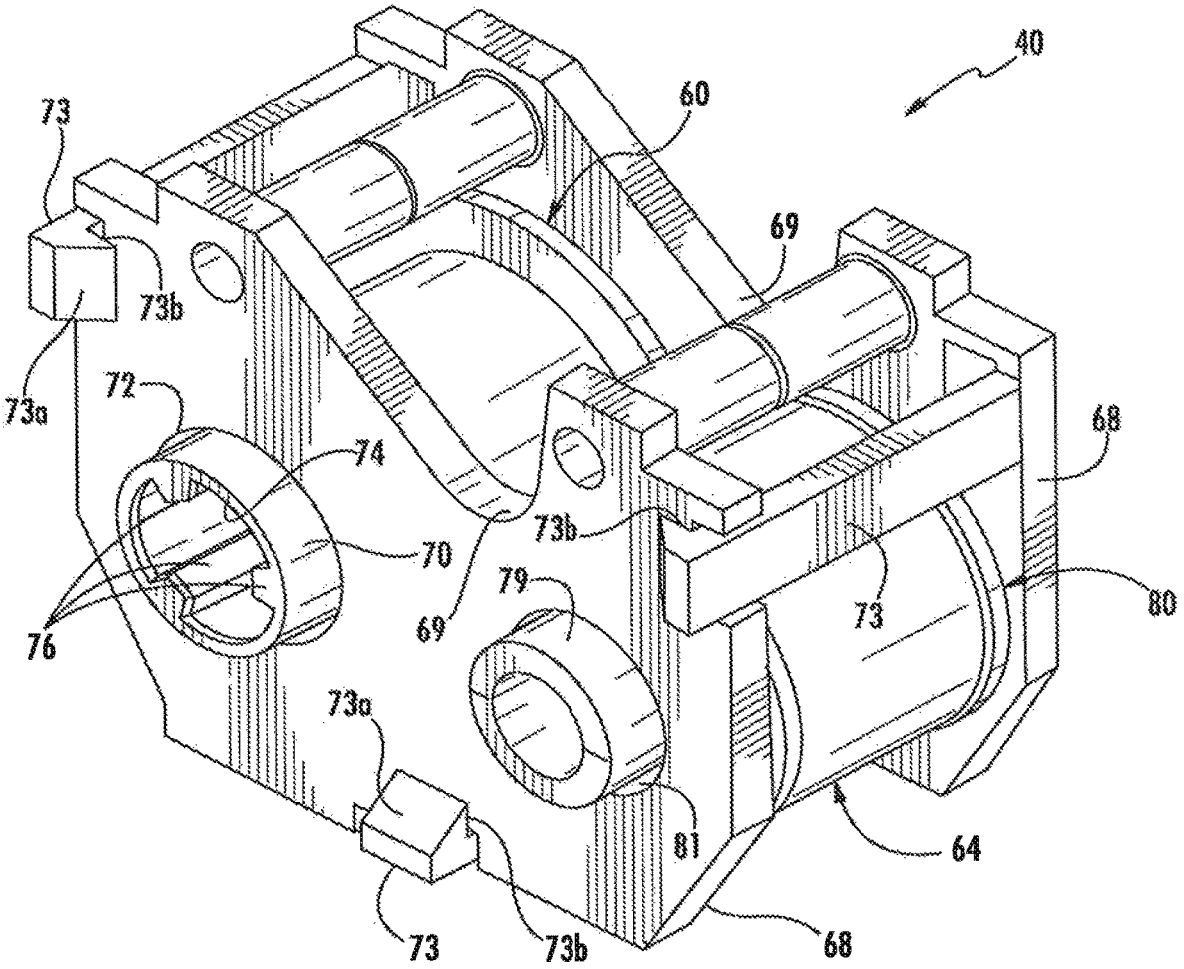
FIG. 4 is a perspective view of an embodiment of a spring motor usable in the operating system of the invention.
Figure 5:
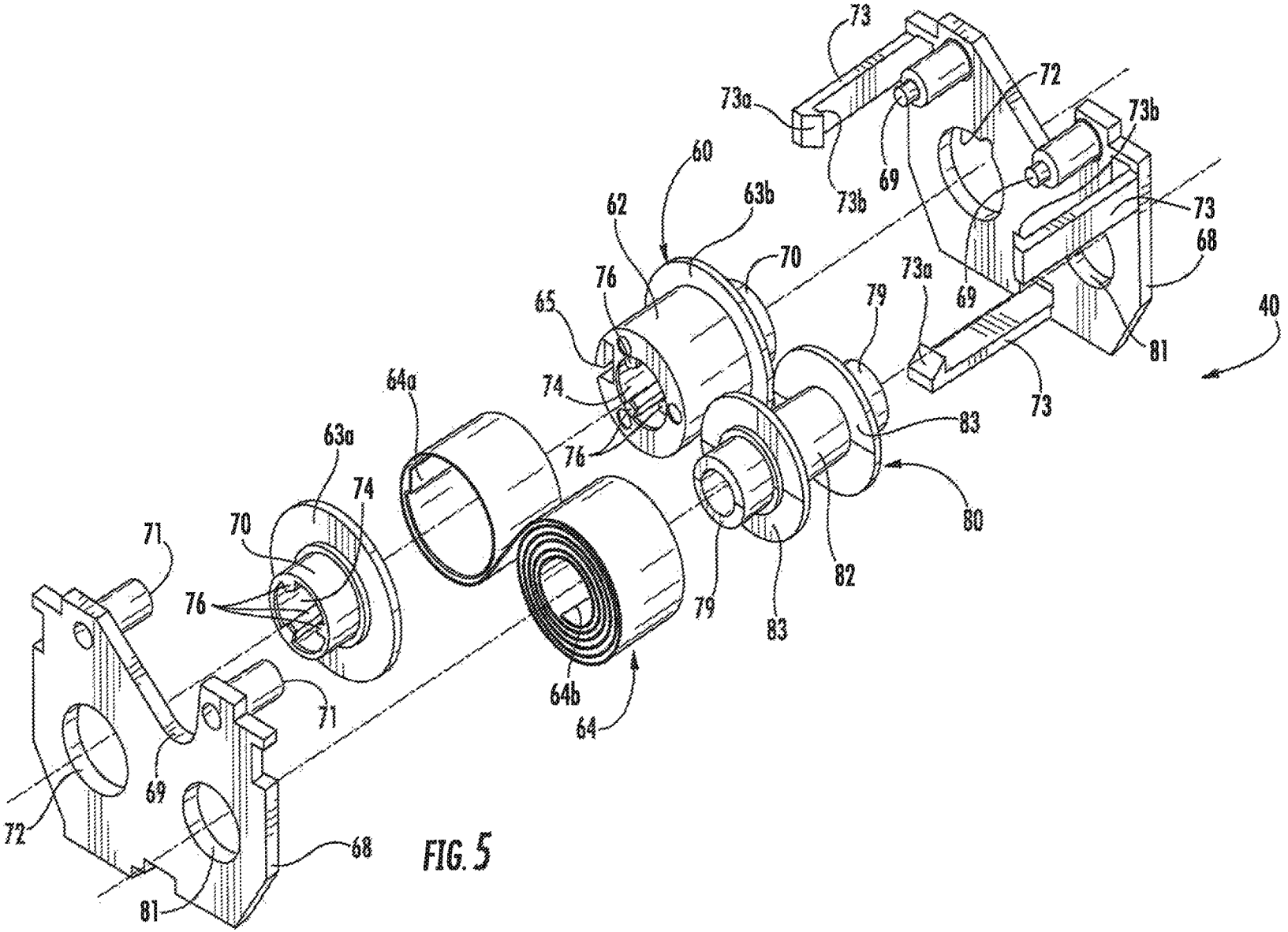
FIG. 5 is an exploded perspective view of the spring motor of FIG. 4.
Figure 6:
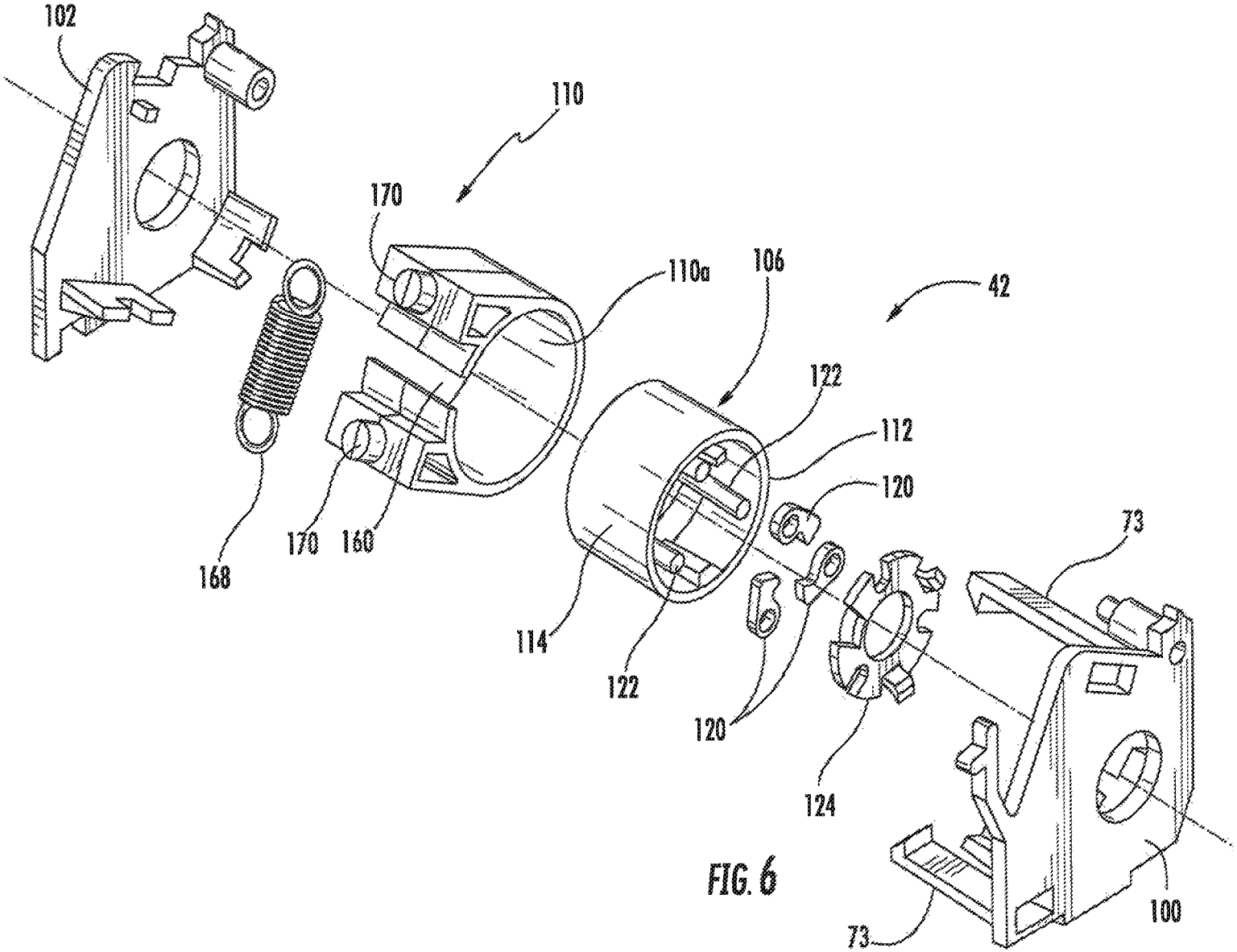
FIG. 6 is an exploded perspective view of an embodiment of a brake usable in the operating system of the invention.

Description of the spring motor 40 will be described with specific reference to FIGS. 4 and 5. According to one embodiment, the spring motor 40 is retained in a housing where the housing may for example comprise a pair of side walls 68 connected to one another to support the components of the spring motor in the head rail. In one embodiment, the side walls 68 may be secured together using a snap-fit connection by inserting pins 69 formed on one of the side plates into mating receptacles 71 formed on the other side plate. A plurality of deformable locking members 73 extend from one of the side walls and engage an edge of the opposite side wall in a snap-fit connection. The deformable locking members may comprise angled camming surfaces 73*a* that may be engaged by the edge of the opposed side wall to deform the locking members to a non-locking position. When the side walls 68 are properly positioned relative to one another the locking members resiliently return toward the undeformed position where locking faces 73*b* engage the edge of the opposite side wall such that the side wall is gripped between the locking members. The side walls 68 may also be connected using separate fasteners and connecting members. The side walls 68 may also be connected by welding, adhesive or any other suitable mechanism. The side walls may include recesses 69 or apertures for receiving the tilt shaft 52.

The spring motor 40 comprises a power or output spool 60 having a drum 62 for receiving a spring 64. Flanges 63*a*, 63*b* extend from opposite sides of drum 62 to retain the spring 64 on the drum 62. The spool 60 may be formed of multiple components as shown in FIG. 5. In one embodiment the end 64*a* of the spring 64 may be inserted into slot 65 formed in the drum 62. The separate flange 63*a* may then be mounted on the drum 62 to hold the spring 64 in position on spool 60. Power spool 60 rotates about an axis formed by axles 70 that are supported in apertures 72 formed in side walls 68. A thru-hole 74 extends through the power spool 60 and defines the axis of rotation of the spool. The shaft 46 extends through thru-hole 74 such that the spring motor 40 may be located anywhere along the length of the shaft 46. The power spool 60 and shaft 46 are operatively coupled together for rotation. The power spool 60 and shaft 46 may be operatively coupled using a keyed connection such as by using mating non-round profiles where the shaft 46 may be inserted through the power spool 60 but the power spool and shaft 46 are constrained to rotate together. As shown, the shaft 46 comprises splines 46*a* (FIG. 9) that extend along the length of the shaft such that a plurality of alternating grooves and projections are formed along the length of the shaft 46. A plurality of mating projections 76 are formed on the interior periphery of hole 74 that engage the splined grooves formed on shaft 46. Such an arrangement allows the shaft 46 to be slid through the hole 74 but constrains the shaft 46 and power spool 60 to rotate together. Other keyed connections or couplers between spool 60 and shaft 46 may also be used such as a cotter sleeve, set screw or the like.

The spring motor 40 also comprises a take-up spool 80 including a drum 82 for receiving the second end of spring 64. Flanges 83 extend from opposite sides of drum 62 to retain the spring on the drum. Spool 80 rotates about an axis formed by axles 79 that are supported in apertures 81 formed in side walls 68

Spring 64 is wound on the power spool 60 and take-up spool 80 such that as the panel 4 is lowered the spring 64 is wound onto the power spool 60 and is unwound from the take-up spool 80. Energy is stored in the spring 64 as it is wound on the power spool 60. As the panel 4 is raised the spring 64 unwinds from the power spool 60 back onto the take-up spool to rotate the shaft 46 and wind the lift cords 21 on the spools 220 of lift spool assemblies 44.

According to one embodiment, the spring 64 may comprise a variable force spring and may be designed such that maximum torque is generated when the panel 4 is fully raised and the load on the lift cords 21 from supporting the full weight of the panel 4 is greatest and a minimum torque is generated when the panel 4 is fully lowered and the load on the lift cords 21 from supporting the panel 4 is lowest. Because the spring force is relatively low when the panel 4 is initially raised from the fully lowered position, the possibility exists that the spring 64 will "billow" around the take-up spool 80 rather than being tightly wound around the spool. To prevent the billowing of the spring 64 the power spool 60 and take-up spool 80 may be operatively connected by gears or other transmission such that the take-up spool 80 is forced to rotate and wind the spring 64 when the panel 4 is initially raised. If the spring 64 does not billow or the billowing of the spring does not cause binding or otherwise interfere with the operation of the motor, the geared connection may be eliminated and take-up spool 80 may be allowed to rotate independently of power spool 60 throughout the entire range of motion.

The arrangement of the spring 64 will be described. According to some embodiments, it may be desired to approximately match the output torque of the spring 64 to the load supported by the spring motor 40 over the entire range of motion of the panel 4 between the fully raised position and the fully lowered position. In a typical window covering the load supported by the lift cords 21 increases as the panel is raised and decreases as the panel is lowered. This is because as the panel is raised the panel stacks on top of itself and on the bottom rail and the stacked load is supported by the lift cords 21. As the panel is lowered the panel unstacks such that more of the load of the panel is transferred to and supported by the tilt cords 20 and/or head rail, depending on the style of window covering, and less of the load is supported by the lift cords 21. Thus, it may be desirable to increase the torque output of the spring motor 40 as the panel is raised and to decrease the torque output as the panel is lowered.

To provide a variable force output, a variable force spring 64 may be used. According to one embodiment, the natural diameter of the spring 64 varies along the length of the spring to produce a variable output. The variable force spring can be created by winding a metal strip into a coil where the spring has a smaller diameter on the inside end of the coil (higher spring force) and an increasingly larger diameter to the outside end of the coil (lower spring force). However, if the spring 64 is mounted on the motor 40 as coiled the smaller diameter would be on the inside of the spring coil and the torque output by the motor 40 would increase as the coil is extended (i.e. the torque would increase as the panel is lowered). This is the opposite force curve desired in the operation of a window covering. To achieve the desired force curve, the spring is mounted on the spools 60, 80 in a reverse manner such that the larger natural diameter is toward the end of the coil at end 64*a* and the smaller natural diameter is toward the end of the coil at end 64*b*. With the coil mounted in the reverse manner the torque output by the spring motor 40 decreases as the coil is extended (i.e. the torque decreases as the panel is lowered) because the highest torque is generated at the end 64*a* of the coil as the spring 64 is just being extended.

It is appreciated that a variable force spring 64 can be generated in a number of other manners, which may also be utilized in the embodiments described herein. For example, a variable force spring may be formed by tapering the spring from a first end of the spring to a second end of the spring such that the thickness and/or width of the spring varies (rather than or in addition to its curvature) along its length. Another example of a variable force spring comprises a spring having a series of apertures or other cutouts formed along the length of the spring where the cutouts increase in size from a first end of the spring to a second end of the spring. Other embodiments for creating a variable force spring may also be used.

In one embodiment, to create the spring motor 40 and assemble the spring motor 40 to the shaft 46, the coil spring 64 is wrapped on the storage spool 80 and the storage spool 80 and power spool 60 are mounted between the side plates 68. The spring 64 is then reverse wrapped on the power spool 80 to preload the spring. The power spool 80 is held in the reversed wrap condition such as by inserting a pin that engages the power spool 60 and one of the side walls 68. The reverse wrapped (preloaded) spring motor 40 is inserted into the head rail of the blind and is connected to the shaft 46 when the panel 4 is in the in the fully lowered position.

It may be difficult to construct the spring motor 40 such that the torque generated by the spring motor exactly matches the varying load of the panel 4. As a result, the spring motor 40 may be designed such that it is intentionally either underpowered or overpowered relative to the load of the panel. If the spring motor 40 is slightly underpowered the panel will tend to sag and if the spring motor 40 is slightly overpowered the panel will tend to creep. A one-way brake 42 is used to prevent the sagging or creeping of the panel 4 depending on whether an overpowered or underpowered spring motor is used. In the illustrated embodiment the spring motor 40 is designed such that the force generated by the spring motor is slightly underpowered relative to the load of the panel 4 and the brake 42 is used to prevent sagging. The operating system of the invention may also be used with an overpowered spring motor where the brake function is reversed to prevent creeping.

One embodiment of a brake 42 suitable for use in the operating system of the invention is shown in FIGS. 6 through 9. The brake 42 may comprise a pair of side walls 100 and 102 that form a housing that trap the brake components and that may be mounted in a head rail. The side walls may be connected together as previously described with respect to spring motor 40. In one embodiment, the spring motor and the brake may be contained within housings that are connected to one another. For example, one of the side walls of the brake 42 may also act as one of the side walls of the spring motor 40 such that the brake 42 and spring motor 40 may form a unit. The spring motor 40 and brake 42 may also be formed as separate units that are independently mounted to the shaft 46 as shown.

The brake 42 comprises a race 106 where the race 106 is selectively connected for rotation with the shaft 46 using a one-way clutch mechanism and is in contact with a band brake 110 that applies the brake force to the race 106. The brake force may be applied to the race 106 using a mechanism other than the illustrated band brake such as a clamp brake, brake shoe and the like.

The race 106 has a generally cylindrical shape that defines a cylindrical outer wall 112 defining an exterior brake surface 114. Located internally of the outer wall 112 is a web 116 that comprises a centrally located bore 118 that receives shaft 46 and defines the axis of rotation of the outer race 106. An axle 121 may be mounted on the shaft 46 and may be coupled to the shaft for rotation therewith. The axle 121 has a cylindrical outside surface that provides a smooth bearing surface on which the edge of bore 118 rides and an inside surface defining projections 119 that engage the grooved splines formed on shaft 46 such that the axle 121 and shaft 46 rotate together. The shaft 46 and the race 108 may be selectively coupled to rotate as a unit. In some embodiments the axle 121 may be eliminated such that there is a space between the shaft 46 and the bore 118 and the shaft rotates inside of bore 118.

Figure 7:
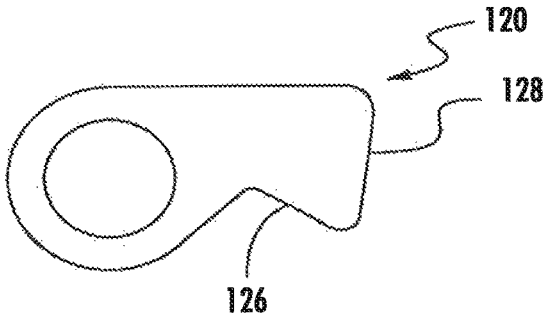
FIG. 7 is a front view of an embodiment of a pawl usable in the brake of FIG. 6.
Figure 8:
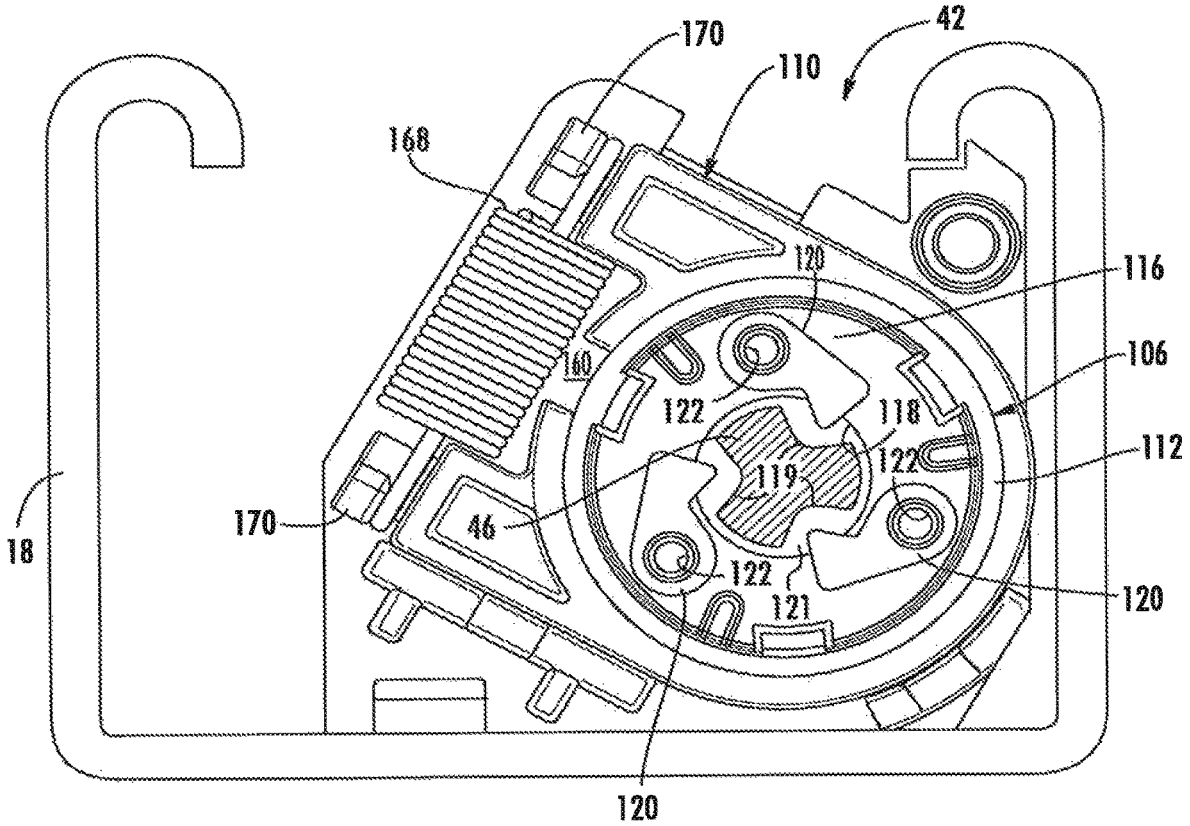
FIG. 8 is a side view of the brake of FIG. 6.

The web 116 supports a plurality of pawls 120 supported for pivoting movement on the web 116. The pawls 120 come in direct contact with the splined lift shaft 46, which acts as an inner race and is selectively locked to the outer race 106. In one embodiment, three pawls 120 are used although a greater number of pawls may be used for a finer braking resolution. The pawls are spaced evenly around the perimeter of the bore 118. The pawls 120 pivot on posts 122 that protrude from the web 118 such that the pawls 120 may rotate freely relative to the race 106. A cover piece 124 may be snapped into the race 106 to keep the pawls 120 in alignment and prevent the pawls from falling off of the posts 122. Referring to FIG. 7, the pawls 120 have a "tooth" geometry comprising a ramp surface 126 that is engaged by the splined shaft 46 when the shaft 46 is rotated in one direction and an abutment surface 128 that engages the splined shaft when the shaft 46 is rotated in the opposite direction. The ramp surfaces 126 are disposed at an angle relative to the leading faces of the splines on shaft 46 such that the ramp surfaces 126 do not lock against the splines on shaft 46. In the raising direction, the longitudinally extending splines of shaft 46 contact the ramp surfaces 126 of the pawls 120. The ramp surfaces 126 are disposed relative to the shaft 46 such that when shaft 46 is rotated in the first raising direction the splines on shaft 46 pivot the pawls 120 about the posts 122 away from the shaft 46 and allow the shaft 46 to rotate relative to the race 106 such that the brake 110 applies no braking force to the shaft 46. In the second lowering direction, the abutment surfaces 128 of the pawls 120 make contact with the side surfaces of the shaft splines such that the pawls 120 engage the splines at a self-locking angle. The pawls 120 are moved into engagement with the shaft 46 under the force of gravity as the shaft rotates. The locking engagement of the pawls 120 with the splines locks the race 106 to the shaft 46 such that the race 106 rotates with the shaft 46 in the second direction. The race 106 rotates inside of the band brake 110, which applies a frictional braking force on the race 106 that is transmitted to the shaft 46 via the pawls 120.

A brake member is provided that contacts the brake surface 114 on race 106 to apply the braking force to the system. In one embodiment, the brake member comprises a band brake 110 that is disposed over the race 106 and includes a substantially cylindrical brake surface 110*a* that contacts the cylindrical brake surface 114 of the race 106. The race 106 rotates relative to the band brake 110 where the friction force between the band brake 110 and the outer race 106 controls the rotation of the race 106, and of the shaft 46 when the pawls 120 are engaged with the shaft 46. The band brake 110 is in the form of a C-shape such that a gap 160 is formed in the band brake between the free ends of the band brake. A force control mechanism is provided to set the brake force applied by the brake 110 to the race 106. In one embodiment the force control mechanism comprises an extension spring 168 that is mounted between the free ends of the band brake such that the spring 168 exerts a force on the free ends of the band brake 110 tending to pull the free ends toward one another to clamp the outer race 106 in the band brake. A post 170 extends from each free end of the band brake to provide attachment points for hooks or rings formed at the opposite ends of the extension spring 168. The ends of the spring 168 may be attached to the free ends of the band brake using other mechanisms. In some embodiments the attachment mechanisms may be releasable such that different springs may be used to vary the braking force applied to the race 106. The extension spring 168 provides the clamping force to the band brake 110. Multiple extension spring designs can be used. For example, a low spring constant will provide less braking force and a high spring constant will provide more braking force. In manufacturing the window covering, different springs can be used for different blinds to provide sufficient braking force based on the weight, size, materials or other factors of the window covering. For example, a heavier panel may require a spring that provides more braking force while a lighter panel may use a spring that provides less braking force. While a stronger spring may be used with a lighter panel, use of a smaller spring reduces the effort required by the user to lower the blind.

Figure 9:
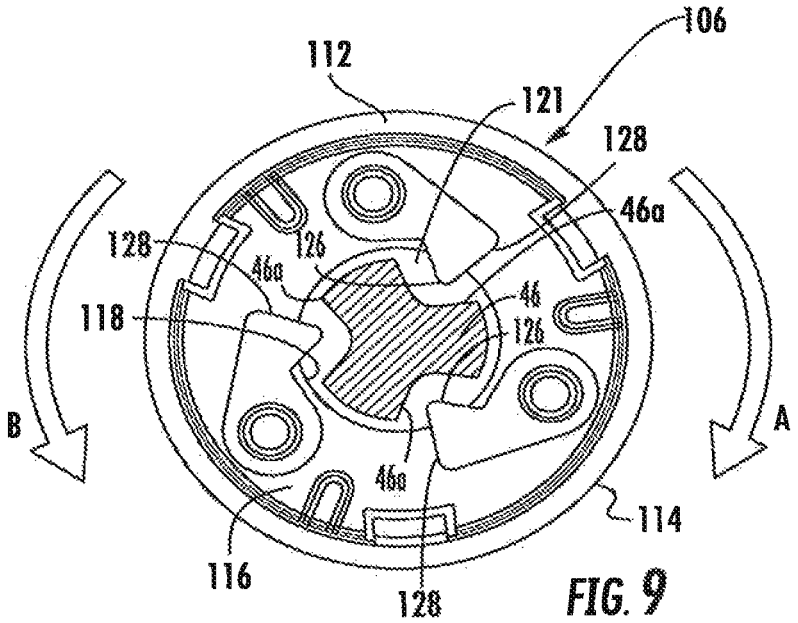
FIG. 9 is a side view of components of the brake of FIG. 6.
Figure 10:
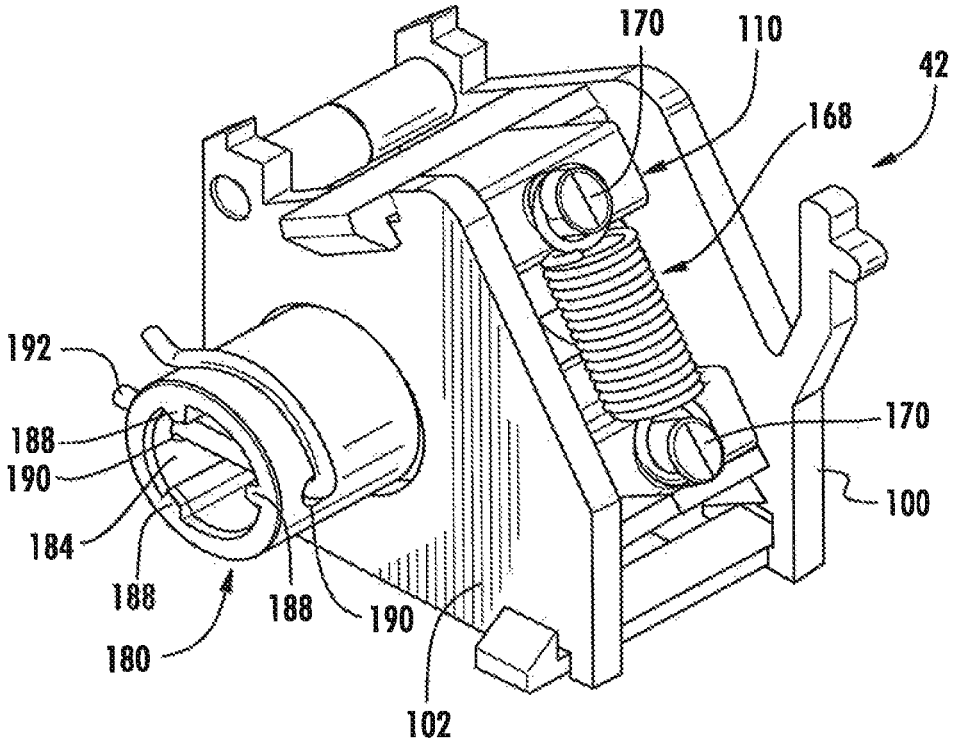
FIG. 10 is a perspective view of another embodiment of a brake usable in the operating system of the invention.
Figure 11:
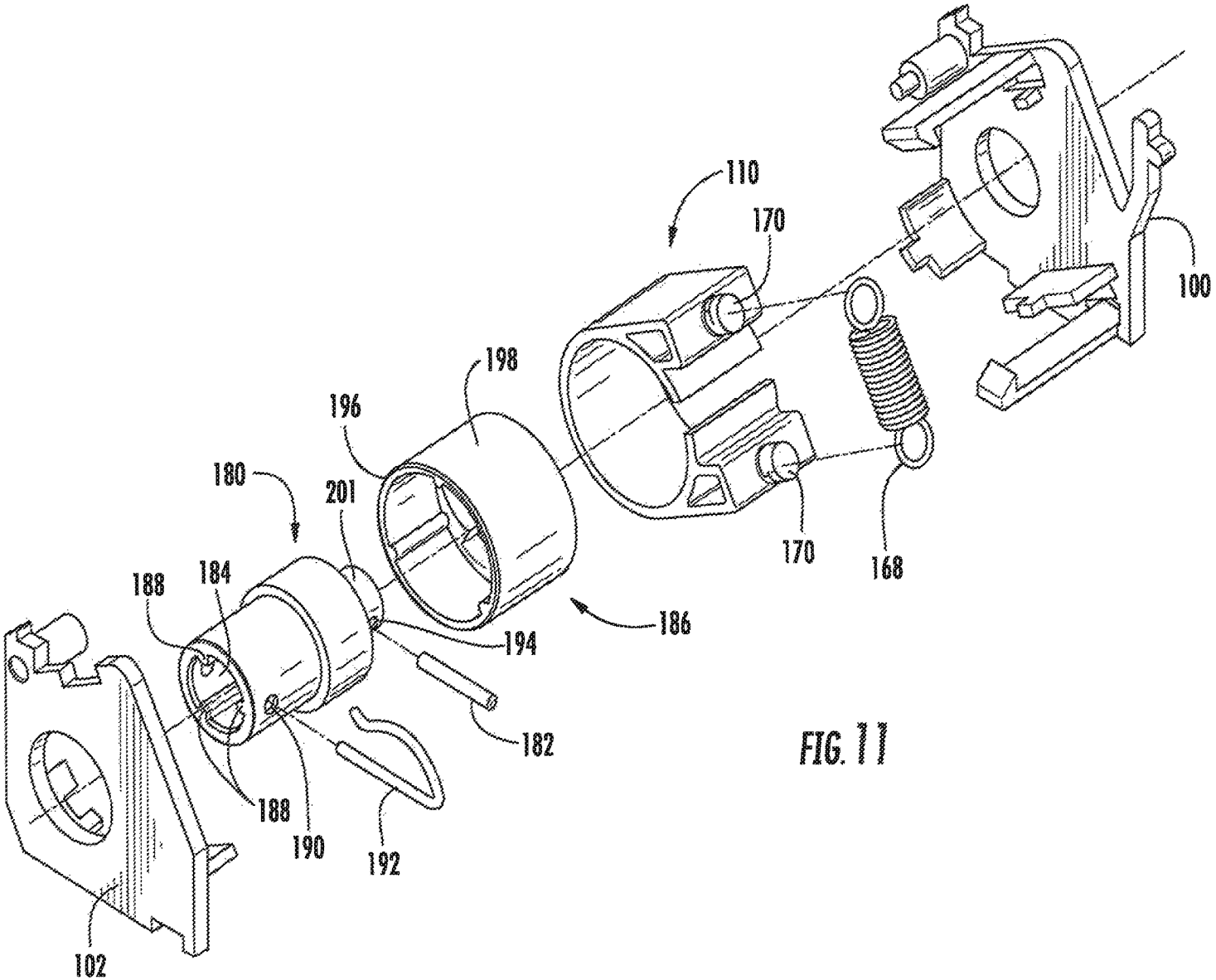
FIG. 11 is an exploded perspective view of the brake of FIG. 10.
Figure 12:
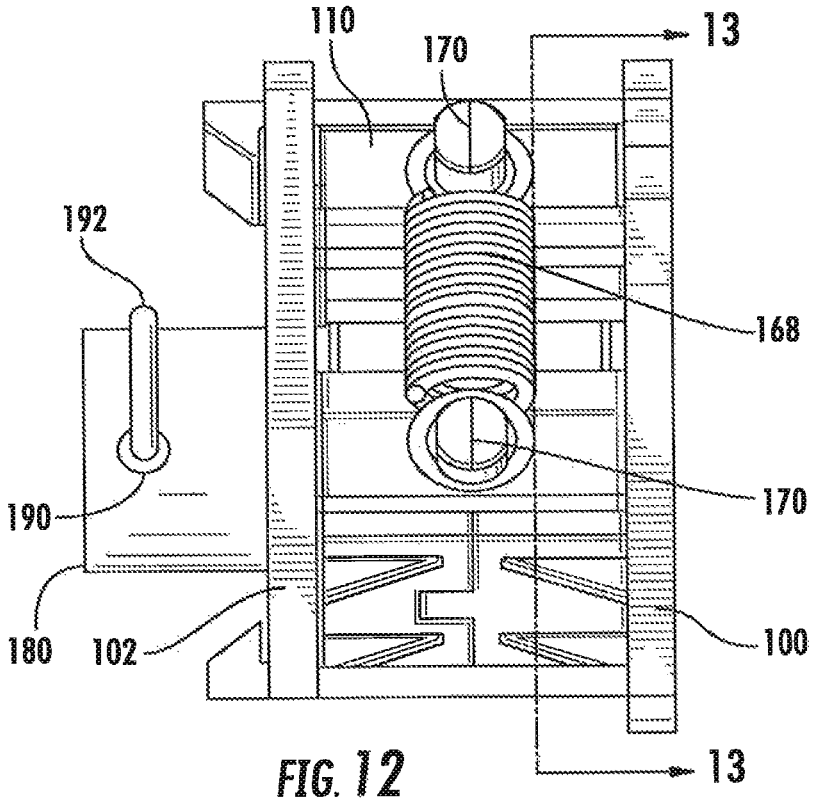
FIG. 12 is an end view of the brake of FIG. 10.
Figure 13:
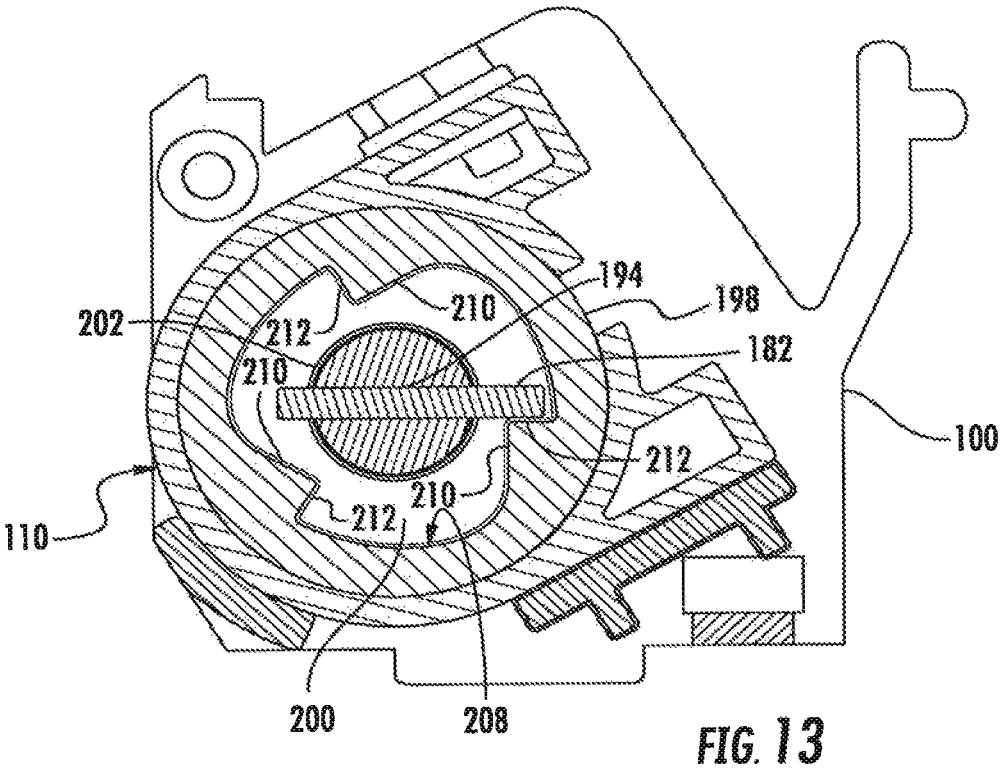
FIG. 13 is a section view taken along line 13-13 of FIG. 12.

Reference will be made to FIG. 9 to describe the operation of the brake 42. To facilitate the explanation of the operation of the system, reference is made to the "clockwise" and "counterclockwise" rotation of the shaft 46. It is understood that in operation the shaft and brake may rotate in either direction to effect braking depending on the orientation and configuration of the components and that the direction of rotation also depends on the point of view of the observer. The arrows in FIGS. 9 and 14 identify the direction of rotation of the shaft 46. When the panel 4 is raised the shaft 46 rotates clockwise as shown in FIG. 9 in the direction of arrow A. As the shaft 46 rotates, the splines 46*a* on the shaft contact the ramp surfaces 126 of pawls 120 pushing the pawls away from the shaft such that the pawls 120 do not lock against the shaft 46. In the unlocked positions the pawls 120 do not lock into engagement with the shaft 46 and the shaft 46 rotates freely relative to the race 106. Because the shaft 46 is not coupled to the race 106 the application of the braking force of band brake 110 to the race 106 does not affect rotation of shaft 46. As long as the shaft 46 rotates in this direction, the pawls 120 are pushed to the unlocked position by the shaft 46. Thus, during the raising of the panel 4 the shaft 46 is rotated by the spring motor(s) 40 to wind the lift cords and to provide lift assist and the brake exerts no braking force on the shaft 46.

When the panel is lowered the shaft 46 rotates counterclockwise as shown in FIG. 9 in the direction of arrow B. The rotation of the shaft may occur in a static situation where no force is being applied to the panel by the user and the rotation is caused by the weight of the static panel as it begins to sag. As the shaft 46 rotates counterclockwise the abutment surface 128 of at least one pawl is engaged by the grooved splines 46*a* of shaft 46. The abutment surfaces 128 and splines are configured such that the abutment surfaces are wedged against the splines 46*a* of the shaft 46. The pawls 120 transfer the rotary motion of the shaft 46 to the race 106 such that the race 106 rotates counterclockwise in the direction of arrow B with the shaft 46. The band brake 110 applies a braking force to the race 106 as previously described. When a user lowers the panel 4 the user pulls the panel down against the force created by the brake 42 and the force generated by the spring motors 40. When the panel 4 is raised and released by the user, the load of the panel 4 is greater than the torque output by the spring motors 40, as previously described. Absent the brake 42, the panel 4 would sag. However, when the panel 4 begins to sag the shaft 46 and race 106 rotate counterclockwise as shown in FIG. 9 such that the pawls 120 lock into engagement with the shaft 46 and the brake 42 is engaged to stop rotation of the shaft. As a result, the sagging of the panel is stopped by the one-way brake 42.

An alternate embodiment of the brake is shown in FIGS. 10-14. In this embodiment a rotational cam surface with a pistoning pin is used as the one-way clutch mechanism. The same components utilized from the previous embodiment are the brake side walls 100, 102, band brake 110, shaft 46 and extension spring 168. In one embodiment, an axle 180 is used to transmit torque from the lift shaft 46 to the pin 182. The pin 182 transmits torque to the race 186. In this embodiment the pin 182 acts as a cam follower and the race 186 acts as the cam.

The axle 180 has a hole 184 that receives an end of the shaft 46 and is keyed to the lift shaft spline geometry. The hole 184 does not extend completely through the axle 180 but terminates short of cylindrical end 201. The hole 184 may include protrusions 188 that engage the longitudinal grooves on the shaft 46 such that the axle 180 may be slid onto the shaft 46 but the shaft 46 and axle 180 rotate together. The axle 180 may be provided with aligned holes 190 that are aligned with a thru-hole on the shaft 46 for receiving a locking pin 192 such that the position of the axle 180 along the length of shaft 46 is fixed to prevent the shaft and/or axle from translating axially and accidentally disengaging the brake.

The cam pin 182 is captured in a thru-hole 194 on the second end 201 of the axle 180 such that the pin 182 extends perpendicular to the rotational axis of the axle 180. The pin 182 is freely movable in hole 194 to allow for axial translation of the cam pin 182 along the thru-hole 194.

The race 186 has a generally cylindrical shape that defines a cylindrical outer wall 196 defining an exterior brake surface 198. Located internally of the outer wall 196 is a web 200 that comprises a centrally located bore 202 that receives axle 180 and defines the axis of rotation of the race 186. The axle 180 has a cylindrical end 201 that provides a smooth bearing surface on which the edge of bore 202 rides. In this embodiment of the operating system the brake is located at one end of shaft 46. The shaft 46 and the race 186 may be selectively coupled to rotate as a unit using the cam pin 182

The race 186 contains a cam surface 208 on the inside diameter that faces axle 180. The cam surface 208 is disposed to the outside of the pin 182 such that the pin may make direct contact with the cam surface 208. The profile of cam surface 208 consists of a ramp surface 210 and a perpendicular abutment surface 212. The abutment surfaces 212 are disposed generally along radii of the rotating axle and may be substantially flat. In this embodiment there are three replicates of the cam profile evenly spaced around the perimeter of the race 186; however, there can be more or less. More cam replicates provide a smaller braking resolution but increase the ramp angle and undesirably create more friction in the raising direction. A tradeoff occurs because the ramp angle has to be less than the self locking angle but the overlap of the cam pin and the abutment surface 212 of the cam needs to be sufficient to prevent slipping. Less cam replicates would create a larger braking resolution but would allow for a larger overlap of the cam pin 182 and abutment surfaces 212.

Figure 14:
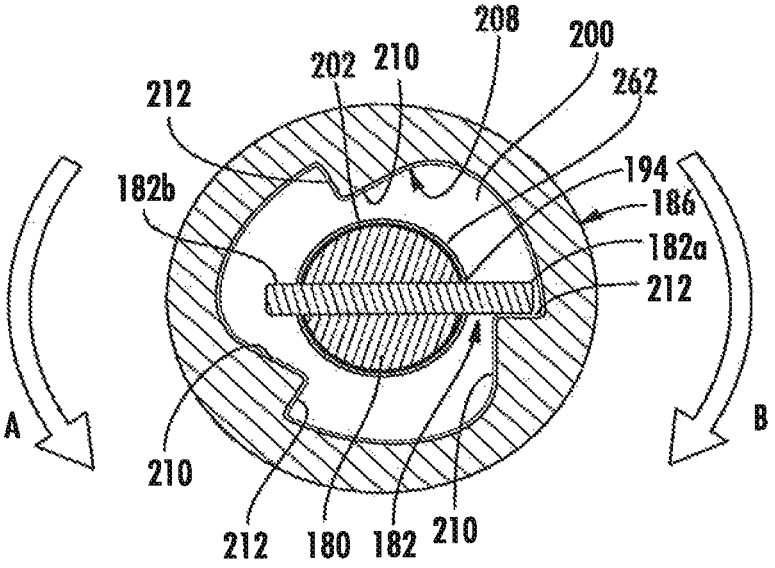
FIG. 14 is a side view of components of the brake of FIG. 10.

Referring to FIG. 14, in the raising direction of the panel, the shaft 46 and the axle 180 rotate in the direction of arrow A, counterclockwise as viewed in FIG. 14. The cam pin 182 rotates with the axle 180 and shaft 46 which causes the first end 182*a* of the cam pin to contact the ramp surface 210 of the cam surface 208, which exerts a normal force on the first end 182*a* of the cam pin 182 causing the cam pin to translate away from the ramp surface. When the first end 182*a* of the cam pin 182 reaches the end of the ramp surface 210 (at the intersection with abutment surface 212), the second end 182*b* of the cam pin is now in the same position as the first end 182*a* at the beginning of the rotation of the shaft such that the second end 182*b* traverses the cam surface 210 in the same manner as the first end. The cycle repeats as the blind continues in the raising direction with the cam pin 182 repeatedly translating in a normal direction to the rotation of axle 180 due to the engagement of the alternating ends of the cam pin 182 with the ramp surfaces 210. The pin 182 does not lock the shaft 46 to the race 186 during rotation in this direction such that the braking force of brake 110 on the race 186 is not transmitted to the shaft 46 and the brake effectively performs no function. Some friction is generated in the system in order to translate the cam pin 182, but this force is small enough to be negligible.

In the lowering direction of the panel, the shaft 46 and the axle 180 rotate in the direction of arrow B, clockwise as viewed in FIG. 14. The cam pin 182 rotates with the axle 180 and shaft 46 such that one end of the cam pin contacts one of the abutment surfaces 212 of the cam surface 208. One end of the cam pin 182 will extend from the axle 180 and be positioned to contact one of the abutment surfaces 212. Engagement of the cam pin 182 with one of the abutment surfaces 212 causes the race 186 to rotate with the shaft 46 such that the frictional force of the brake 110 on the rotating race 186 is applied to shaft 46 such that the shaft is braked and the panel is prevented from sagging.

Figure 18:
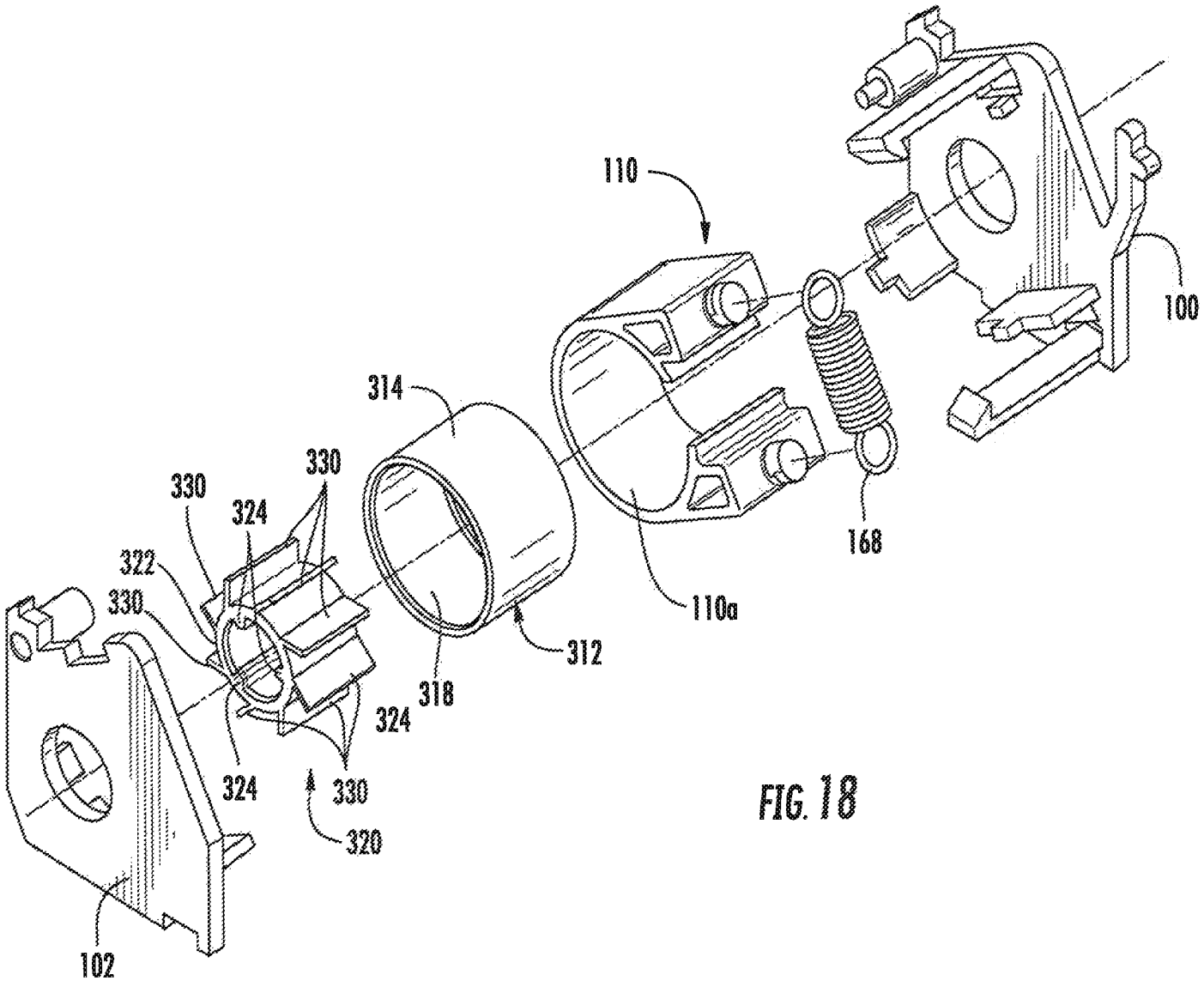
FIG. 18 is a perspective exploded view of another embodiment of a brake usable in the operating system of the invention.
Figure 19:
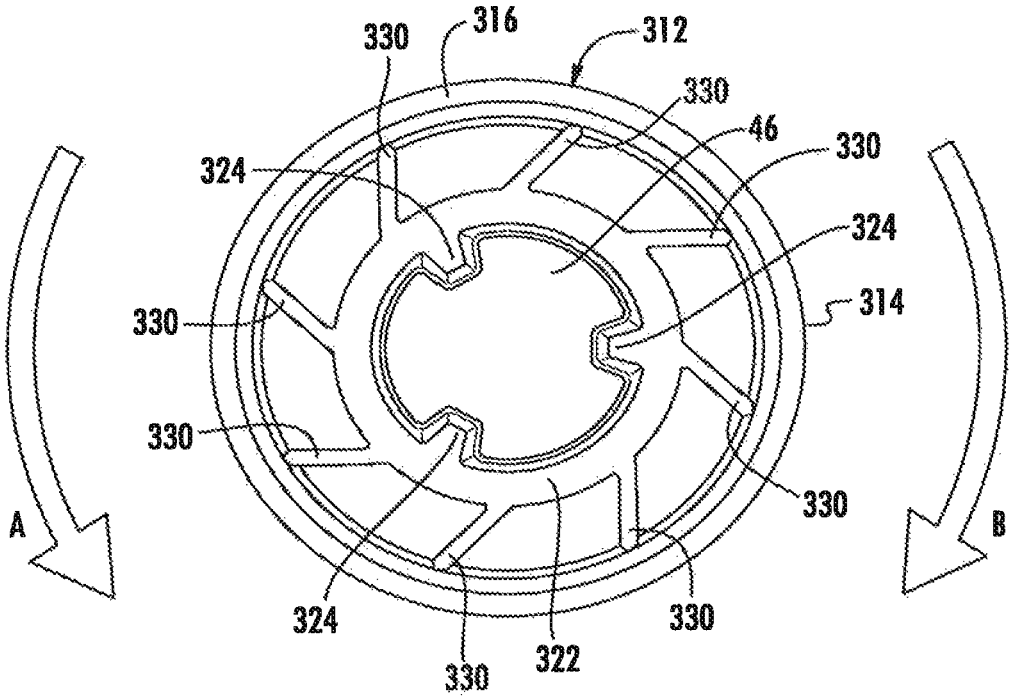
FIG. 19 is a side view of components of the brake of FIG. 18.

Another alternate embodiment of the brake is shown in FIGS. 18 and 19. In this embodiment a sprag-type clutch is used as the one-way clutch mechanism. The same components utilized from the previous embodiment are the brake walls 100, 102, band brake 110, shaft 46 and extension spring 168. The brake 42 comprises a race 312 where the race 106 is selectively connected for rotation with the shaft 46 using a one-way clutch mechanism. The race 312 has a generally cylindrical shape that comprises a cylindrical outer wall 316 defining the exterior cylindrical brake surface 314 and an interior cylindrical clutch surface 318. Cylindrical outer brake surface 314 is in contact with a band brake 110. The brake force may be applied to the race 312 using a mechanism other than the illustrated band brake such as a clamp brake, brake shoe and the like.

The sprag clutch 320 acts an inner race that may be selectively coupled for rotation with the outer race 312 or decoupled from the outer race 312 such that the sprag clutch 320 rotates independently of the outer race 312. The sprag clutch 320 comprises a cylindrical hub 322 that receives shaft 46 and has a plurality of inwardly facing projections 324 extending from the interior surface of hub 322. The projections 324 engage the grooved splines formed on shaft 46 such that the shaft 46 and sprag clutch 320 are coupled to rotate together.

A plurality of sprags 330 extend from the outer surface of the hub 322 and engage the inner surface 318 of the outer race 312. In one embodiment the sprags 330 comprise generally planar vanes or plates that extend at an angle from the hub 322 that are offset from the normal direction from the hub. By this arrangement the sprags 330 contact the inner surface 318 of the race 312 at an angle that allows the outer race 312 to rotate relative to the sprags 330 in a first direction such that the sprag clutch 320 and outer race 312 rotate independently but that locks the sprags 330 to the inner surface 318 in a second direction such that the sprag clutch 320 and outer race 312 are constrained to rotate together. Referring to FIG. 19 when the shaft 46 and the sprag clutch 320 rotate in a first direction as represented by arrow A that corresponds to the raising of the blind panel, the angle of the sprags 330 relative to the inner surface 318 of the outer race 312 allows the sprags 330 to slide over the inner surface 318 such that the sprag clutch 320 is decoupled from the outer race 312 and the brake 110 exerts no noticeable force on the shaft 46. When the sprag clutch 320 rotates in a second direction as represented by arrow B that corresponds to the lowering of the blind panel, the angle of the sprags 330 relative to the inner surface 318 of the outer race 312 binds the sprags 330 to the inner surface 318 such that the sprag clutch 320 is coupled to the outer race 312 and the brake 110 exerts a braking force on the outer race 312 and therefore on the shaft 46 via the spring clutch 320. While eight evenly spaced sprags 330 are shown a greater or fewer number of sprags may be used. Further, while the sprags 330 are shown as planar members that extend from and are formed as one-piece with the hub 322, the sprags 330 may have a variety of shapes and configurations. The use of a hub 322 with simple planar sprags 330 allows the clutch to be molded as one-piece from, for example plastic, to provide a relatively inexpensive clutch mechanism. While an inexpensive sprag clutch 320 is shown the sprags 330 may comprise members that are separate from the hub 322 and may have complex geometries that allow the sprags to wedge between the hub 322 and the interior surface 318 of the outer race 312. Moreover, in some embodiments the sprags may be spring biased.

Figure 15:
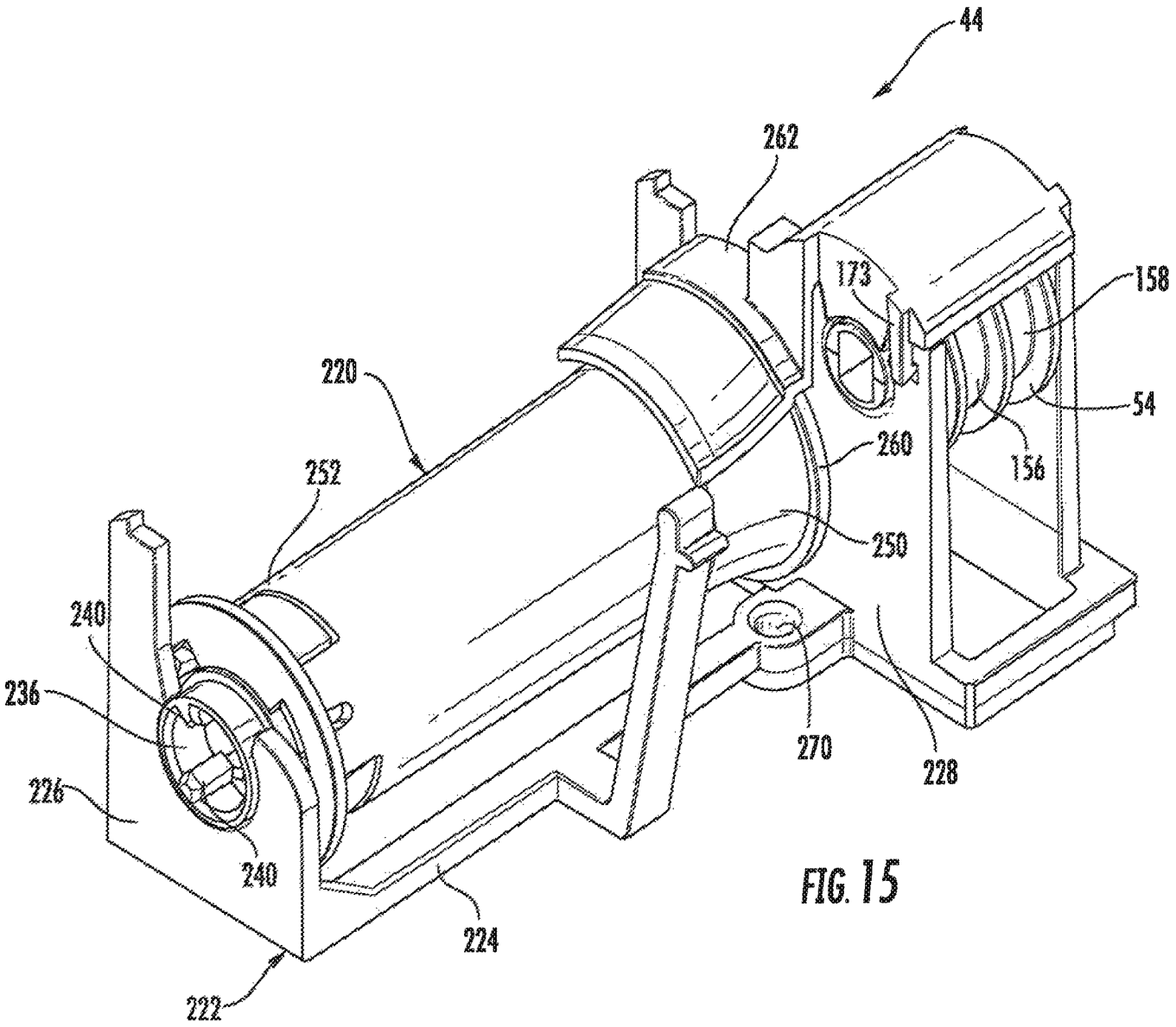
FIG. 15 is a perspective view of an embodiment of a spool assembly usable in the operating system of the invention.
Figure 16:
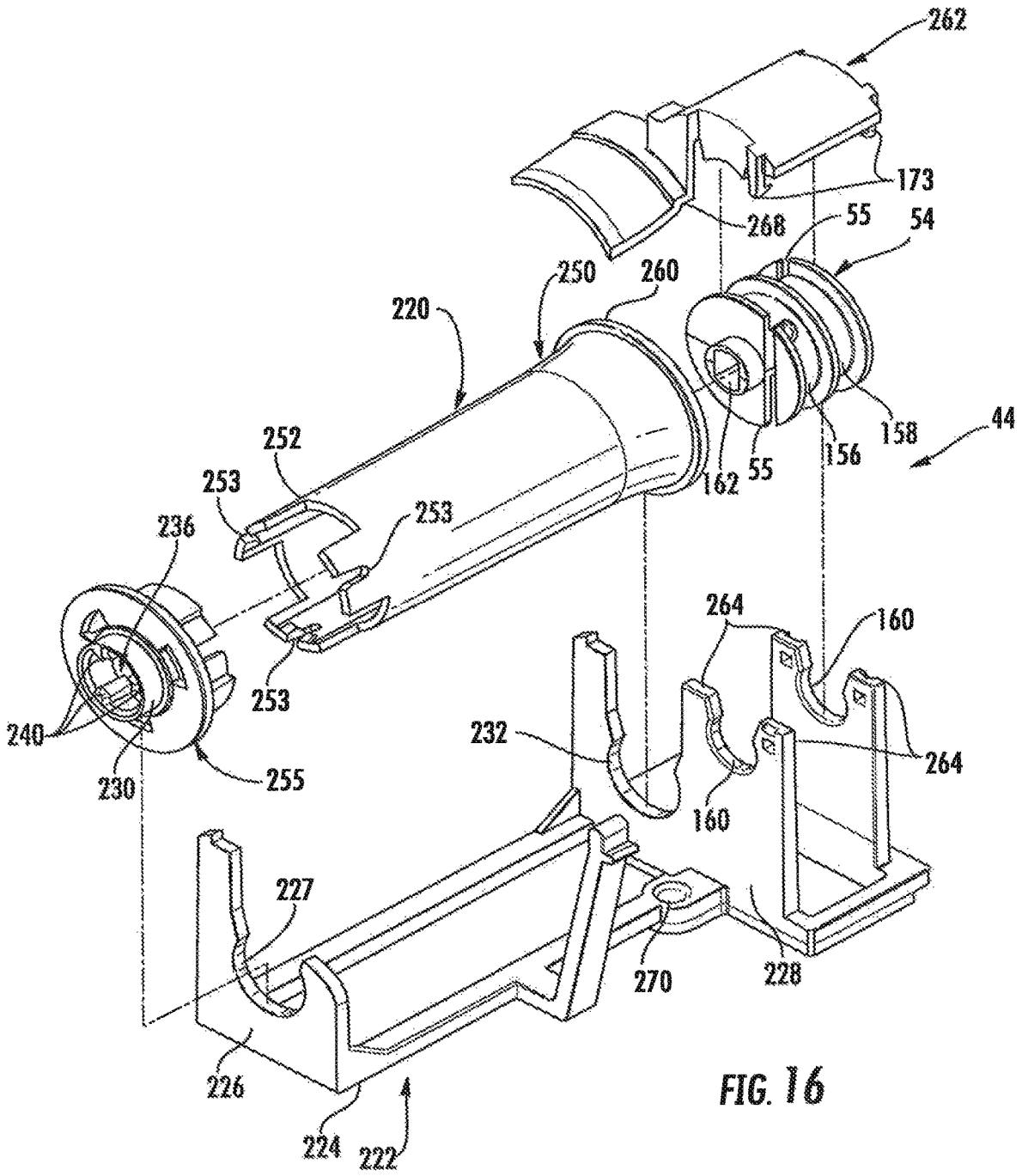
FIG. 16 is an exploded perspective view of the spool assembly of FIG. 15.
Figure 17:
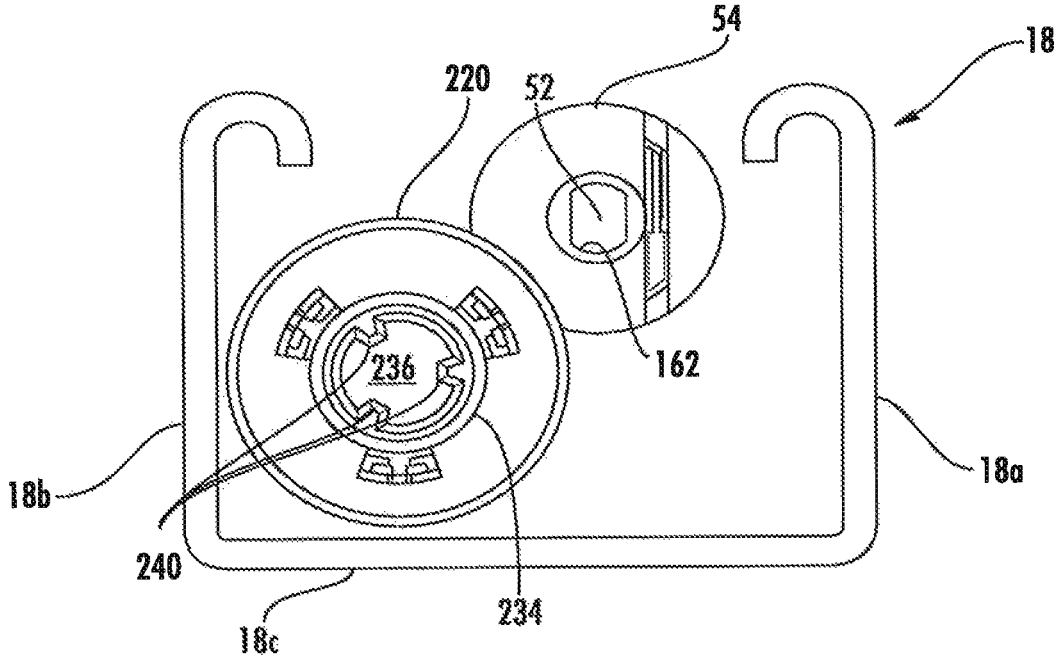
FIG. 17 is an end view of the spool assembly of FIG. 15.

One embodiment of a lift spool assembly 44 suitable for use in the operating system of the invention is shown in FIGS. 15 through 17. The lift spool assembly 44 comprises a spool 220 supported on a cradle 222. The spool 220 ensures that the lift cord 21 wraps onto the spool 220 evenly such that with each revolution of the spool the lift cord does not overlap on itself on the spools.

The cradle 222 comprises a base 224 and a pair of side walls 226 and 228. The side walls 226 and 228 rotatably support the spool 220. The first side wall 226 includes a first aperture 227 that receives an axle 230 formed on one end of the spool 220 and the second side wall 228 includes a second aperture 232 that receives a second axle 234 formed on the opposite end of the spool 220. The spool 220 may be made of multiple components secured together to form the spool as shown. The axles 230, 234 include thru-holes 236 that receive the shaft 46 such that shaft 46 extends through spool 220. The shaft 46 and the spool 220 are keyed together and rotate as a unit. In the illustrated embodiment the shaft 46 includes longitudinally extending splines that are engaged by protrusions 240 formed in thru-hole 236; however, other keyed connections for providing coordinated rotation may be used.

The spool 220 is formed with a sloped arcuate receiving end 250, which may have an arcuate shape in one embodiment, at the end of the spool that receives the lift cord. The receiving end 250 narrows to opposite end 252 such that the spools have a tapered shape. The arcuate section of spool 220 forces the cord to slip downward toward the slightly tapered end 252 of the spool. Decreasing the surface friction of the spool material or increasing the slope of the arcuate section makes the cord slide down the spool more easily. However, if the curvature of the arcuate section is too steep the cord may be more likely to wind on top of itself. The slight taper of the spools ensures that the cord sections already wrapped on the spool remain looser than the cord sections being wrapped on the spools to allow the cords to be pushed down the spool with minimum force with each winding of the cord. The tapered shape of the spool facilitates the orderly winding of the lift cords on the spools such that as each cord is wound on a spool the cord is moved from the wider receiving end toward the narrow end such that the cord does not wind on itself.

The spool 220 also includes a flange 260 that extends radially from the end of the spool to create a wall or abutment that prevents a lift cord from jumping off the end of the spool. To further maintain the cord on the spools a cradle cover 262 may be provided on the top of the spool 220 that is spaced from the spool a distance such that the cord is constrained to wrap onto the spool rather than jumping off the spool. The cradle cover 262 may be snap-fit onto posts 264 formed on the cradle after the spools are mounted on the cradle. Resilient members 173 may be used to create the snap fit connection as previously described. The cover 262 comprises a recess 268 for receiving the flange 260 of the spool 220 to create a serpentine or tortuous path to the end of the spool to prevent the cord from jumping off of the end of the spool. The cradle cover 262 prevents the lift cords from lifting off of the spools when the blind is raised. For example, if a user lifts the panel quickly, the spring motor may not take all of the slack out of the lift cord such that the cord may be pushed up by the user where it may tend to jump off of the spool or wind on top of a previous cord winding. Either failure mode can lead to an uneven bottom rail and may create additional unwanted friction to the system during operation. The cord winding mechanisms discussed above also prevent the lift cords from jumping off of the spools or becoming tangled during shipping when the cords may not be under tension. The cover 262 may also cover the tilt drum 54 to prevent the tilt cords from becoming disengaged from the tilt drum 54.

The spool assembly 40 may also be a two spool arrangement that is used with a privacy-type lift cord. A privacy-type lift cord is wound around one spool, extends down the front side of the panel, wraps under or through the bottom rail and extends up the back side of the panel 4 where it is wound around the second spool. In a two spool arrangement the first spool may be operatively connected to the second spool by a suitable transmission such that the two spools rotate together to raise and lower the panel. The transmission may comprise gears, belts or other suitable transmission.

Assembly of the operating system will now be described according to one example embodiment. A head rail 18 is provided that may have an interior space for receiving the operating system. In the illustrated embodiment, the head rail has a U-shape such that the top of the head rail is open and allows access into the interior space. Other head rail designs may also be used. The cradles 224 for the lift spool assemblies 44 may be inserted into the head rail 18. The spring motors 40 and brake 42 are inserted into the head rail at any position along the length of the head rail provided that the components may be engaged by the shaft 46. Each spring motor 40 is positionable at any unoccupied location on the shaft 46. Unoccupied location as used herein means that the motors 40 may be located at any position on the shaft 46 where a brake 42 or spool assembly 44 is not positioned. Because the shaft 46 can extend through the motors 40 the motors can be positioned anywhere along the length of the shaft 46. In practice the motors 40 may be positioned in any unoccupied location along the shaft 46 where another component is not located. This is also true for the brakes 42 and spool assemblies 44; however, the spool assemblies 44 are typically located directly above the lift cords 21 such that these areas are not unoccupied locations for the brakes and motors. Moreover, in some embodiments it may be desirable to mount the brake 42 at or near one end of the shaft 46. The spring motor(s) applies a first force directly to the shaft at a first location(s) along the shaft and the brake applies a brake force to the shaft at a second location along the shaft where the first location is spaced along the longitudinal axis of the shaft from the second location. In this manner the brakes and motors act directly on the shaft and the locations on the shaft where the motor force and the brake force are applied are be spaced from one another. Because the motor force is applied directly to the shaft 46 via the spool 60 and the brake force is applied directly to the shaft 46 via brake 42 these forces may be applied to the shaft independently of one another and directly to the shaft.

In one embodiment, the components of the system snap into the head rail such that separate fasteners are not required, however, other mounting mechanisms including the use of separate fasteners may be used. While an embodiment of a lift system is shown the lift system may comprise a greater or fewer number of each component and the components may be arranged in other relative positions along the length of shaft 46.

The lift spool assemblies 44 are arranged in a one to one relationship with the lift cords 21 such that for a typical window covering where two lift cords are used, two lift spool assemblies 44 are also used. For larger window coverings, three or more lift cords may be used and a corresponding number of lift spool assemblies 44 are also used. Each lift spool assembly 44 can be arranged proximate to (i.e. approximately above) the associated lift cord 21 such that the lift cord 21 is wrapped onto the spool 220 at the large diameter receiving end 250 of the spool 220. An aperture is provided in the head rail 18 and an aperture 270 is provided in the cradle 224 to receive the lift cords 21. A knot may be tied in the end of the lift cord 21 that is inserted into one of the notches 253 at the end of the spool. While only one notch may be provided using additional notches may make assembly of the window covering easier. A separate flange piece 255 may be snapped on the spool 220 to retain the lift cord 21 in position.

While more than one lift cord is typically provided on a window covering, the installation and arrangement of a single lift cord is described herein it being understood that the arrangement and installation of additional lift cords is accomplished in the same manner. The lift cord 21 extends from adjacent the bottom rail and up through the panel 4. For panels such as a slatted blind the tilt cords, such as a ladder tilt cord, may be provided to tilt the slats between open and closed positions.

A first end of the lift cord 21 is threaded through an aperture in the head rail and through aperture 270 in the lift spool cradle 224. The cord is operatively coupled to the spool 220 such that rotation of the spool winds the lift cord on the spool. The lift cords may be operatively coupled to the spools using any suitable mechanism. The spool 220 is snapped into the cradle 224. These steps are repeated for attachment of the second lift cord 21 to the second spool.

The panel 4 is then suspended vertically from the bead rail 18 by the lift cords. The lift cords 21 are wound on the spools to take the slack out of the lift cords such that the panel is suspended at its full length and there is no slack in the lift cords. The shaft 46 is inserted through the mating keyed receptacles on the motor(s) 40, brake(s) 42 and spool(s) 220 to create the lift system as shown, for example, in FIG. 1. The pins are then pulled out of the preloaded spring motors 40. The panel 4 is raised by lifting the bottom of the panel and/or bottom rail. As the panel 4 is raised the spring motors 40 operate as previously described to wind the lift cords 21 on the spools 220 and assist in raising the panel.

For a top down shade, where the top edge of the panel may be raised and lowered relative to the head rail, the operating system may be connected to the top edge of the panel 4 to control the movement of the top edge of the panel. In top down shades the top edge of the panel may include a middle rail. The lift cords are connected to the top edge or middle rail rather than to the bottom edge of the panel or bottom rail. In a top down shade the load on the system increases as the panel is raised because as the top of the panel is raised more of the shade panel is suspended from the top rail (rather than resting on the bottom rail) such that the operating system operates in the same manner to support the load and facilitate the raising and lowering of the top edge of the panel as previously described. "Top down/bottom up" shades are also known where the top edge/middle rail and the bottom edge/bottom rail are independently movable. In such systems two operating systems may be used where one operating system is connected to the top edge/middle rail and the other operating system is connected to the bottom edge/bottom rail. The two operating systems operate independently to control the movement of the panel.

Referring to FIG. 1, because the components such as the brakes 42, lift spool assemblies 44 and motors 40 are independent from one another and modular, these components may be located anywhere along the length of the shaft 46. The components all use a keyed receptacle or other coupler that engages the shaft 46. While the brakes, spring motors and drive spools are described as being operatively coupled to one another using non-round receptacles and a mating non-round shaft 46, the coupling may comprise other mechanisms. For example, the shall and receptacles may have round profiles and a separate coupling collar, cotter pin or set screw arrangement or the like may be used to key the components together. Because the receptacles may extend completely through the components, the shaft 46 may be inserted through the components and the components may be mounted in any position and in any order in the head rail and along the shaft. In one embodiment the shaft 46 is fiberglass to accommodate small variations in the linearity of the path between the components.

In one embodiment a single shaft 46 extending through all of the components may be used; however, in other embodiments the shaft may be provided as multiple segments where a segment extends between the components such as between the motors, cradle, and brake. For example, a first shaft segment may extend from the left end of the head rail through a first spool assembly and a first motor and terminate inside of the spool of a second spool assembly where the shaft is operatively coupled to the spool. A second shaft segment may extend from, and be operatively coupled to, the spool of the second spool assembly and extend through the remaining components such as brake 42. In such an embodiment, the shaft segments function as a single shaft because the shaft segments are operatively coupled to one another by the common component(s) (the spool of the second spool assembly in the present example). While a system with a single shaft 46 and a two segment shaft have been described other embodiments using a greater number of shaft segments may be used where the shaft segments are coupled in series by the common components such that the shaft segments are operatively coupled to one another to form an effective shaft that synchronizes the movement of the components.

Because the components are modular and independent from one another, the motors 40 may be positioned anywhere along the length of the shaft 46 and the motors do not have to be co-located with one another. This provides an advantage because the torques exerted on the shaft 46 by the motors 40 may be spread out along the length of the shaft 46 to shorten the length of the shaft over which the torques are applied. In systems that place all of the motors at one end of the shaft significant twisting forces are accumulated over the length of the shaft. In the system of the invention, where the motors 40 may be placed anywhere along the length of the shaft 46, the load accumulation may be minimized. For example, if four lift spool assemblies 44 are used and three motors 40 are required to handle the load of the panel 4, the motors 40 may be alternated with the lift spool assemblies 44 along the length of the shaft 46 such that the torsional load on the shaft is minimized. Moreover, the number of motors 40 is not tied to the number of lift cords 21, lift spool assemblies 44 or brakes 42 such that the motors, lift cords, lift spool assemblies and brakes may be provided as needed.

Additional lift spool assemblies 44, brakes 42 and motors 40 may also be added to the system by simply adding more components into the head rail before inserting the shaft 46. As a result, the system may be easily scaled to work with larger or smaller or heavier or lighter window coverings. Because all of the components are synchronized through the shaft 46, it is possible to scale up the system by multiplying the number of motors 40 by the factor of the window width. For example, for a particular window covering style the motor may be sized for a particular span (e.g. 12 inches) and then propagated in multiples of that basic span to create larger span window coverings or window coverings having a greater mass (e.g. panel mass may change with slatted blind compositions, such as real wood, faux wood, composites etc.). The length of the shaft 46 may be increased for larger and/or heavier window coverings to accommodate additional components but because the components may be located at any location along the length of the shaft excessive twisting loads are not created on the shaft. The operating system may also be scaled to very short spans, as small as 6 inches, by locating all of the components in close proximity to one another. The modular system simplifies the manufacture of the window covering, is scalable, allows easy replacement of components and is relatively inexpensive.

The operating system also accommodates a tilt system for use with slatted blinds where the slats may be tilted for light control and privacy in addition to being raised and lowered. The tilt system may be omitted in window coverings such as cellular shades or Roman shades or the like where tilting of slats is not required. The tilt system comprises a second tilt shaft 52 on which at least one tilt drum 54 is provided. One tilt drum 54 is provided for each tilt cord 20 such that in a typical window covering two drums 54 are provided and in larger blinds three or more tilt drums 54 may be used. The tilt drum 54 comprises a first drum 156 for receiving a first vertical cord 28 of the tilt ladder 20, a second drum 158 for receiving a second vertical cord 30 of the tilt ladder 20 and bearing surfaces 160 for supporting the tilt drum 54 for rotary motion. A knot may be formed at the end of each vertical cord that is inserted into a slot 55 formed in the sides of the tilt drum 54. The tilt drum 54 also comprises a thru-hole receptacle 162 for receiving the shaft 52 such that the shaft 52 and tilt drum 54 rotate together. The tilt system also comprises a tilt assembly that rotates the shaft 52. The tilt assembly comprises an actuator such as a tilt wand or cord 25 that is manipulated to rotate the shaft 52. The tilt cord or wand 25 may be operatively coupled to the shaft 52 by a suitable transmission such as a gear train. The shaft 52 is operatively coupled to the output of the transmission and is inserted through the keyed receptacles 162 of the tilt drums 54. The tilt drums 54 may be supported on bearing surfaces 160 on the side walls that form part of the lift spool assemblies 44. The bearing surfaces 160 may be formed as recesses in the top ends of the side walls. Other arrangements for rotatably supporting the tilt drums 54 and or shaft 52 may also be used. One vertical cord 28 of the tilt cord ladder is wound on one drum 156 in a first direction and the other vertical cord 30 of the tilt cord ladder is wound on the other drum 158 in a second direction such that as the drums 54 are rotated clockwise and counterclockwise the front and rear vertical cords are alternately raised and lowered to tilt the slats.

Referring to FIG. 17 the cradle 222 positions the spools 220 and the drums 54 to minimize the amount of space occupied by these components to allow a narrower head rail to be used. In one embodiment the head rail comprises a front wall or surface 18*a*, a back wall or surface 18*b* and a bottom wall or surface 18*c*. For example, using an operating system arranged as described the head rail can have a depth between the front surface 18*a* and the back surface 18*b* and a height that are similar to the dimensions of corded window coverings. For example, in a slatted mini blind with 1 inch slats the head rail may have a depth of approximately 1 inch and a height of approximately ¾ inch. The spool 220 is located with minimum clearance from the back wall 18*b* and bottom wall 18*c*. The drum 54 is located adjacent to the spool 220 and is slightly offset toward the front wall 18*a* from the symmetrical center of the head rail 18 which provides clearance for the tilt shaft 52 with minimum offset above the spool 220.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. An operating system for a window covering comprising:

a spring motor;

a brake including a race and a brake member configured to engage said race;

a lift spool assembly; and a shaft coupling said spring motor, said brake, and said lift spool assembly to one another, said shaft being rotatable about a rotational axis;

wherein:

said race is configured to be selectively coupled for rotation with said shaft by a pin that intersects said rotational axis of said shaft and is coupled to said shaft for rotation therewith.

2. The operating system as in claim 1, wherein:

said race is rotationally supported relative to said shaft by an axle coupled to said shaft;

said axle defines an opening configured to receive a portion of said pin; and said pin is movable within said opening along a lengthwise direction relative to said race and said shaft.

3. The operating system as in claim 1, wherein:

said pin extends within said race along a lengthwise direction between a first end of said pin and a second end of said pin;

said pin is movable in the lengthwise direction relative to said race and said shaft; and said rotational axis of said shade intersects said pin between said first and second ends of said pin.

4. The operating system as in claim 1, wherein:

said race defines a cam surface; and said pin is configured to contact said cam surface to allow said race to move with said shaft.

5. The operating system as in claim 4, wherein said cam surface defines a profile such that, when said shaft is rotated in a first direction, said pin is translated along a lengthwise direction as said pin contacts said cam surface and, when said shaft is rotated in a second direction, said pin engages said cam surface to allow said race to move with said shaft.

6. The operating system as in claim 5, wherein said first direction corresponds to a raising direction for the window covering and said second direction corresponds to a lowering direction for the window covering.

7. A brake assembly for use with an operating system for a window covering, said brake assembly comprising:

a shaft;

a brake including a race and a brake member configured to engage said race, said race configured to be selectively coupled to said shaft by a pin provided in operative association with said shaft;

wherein:

said pin extends within said race along a lengthwise direction between a first end of said pin and a second end of said pin opposite said first end;

said race defines a cam surface; and said pin cyclically reciprocates in the lengthwise direction with relative rotation between said shaft and said race such that said opposed first and second ends of said pin alternatingly engage said cam surface.

8. The brake assembly of claim 7, wherein:

said shaft is rotatable about a rotational axis; and said rotational axis of said shaft intersects a portion of said pin extending between said opposed first and second ends of said pin.

9. The brake assembly as in claim 7, wherein said race is rotationally supported relative to said shaft by an axle coupled to said shaft.

10. The brake assembly as in claim 9, wherein:

said axle defines an opening configured to receive a portion of said pin; and said pin is movable within said opening along the lengthwise direction relative to said race and said shaft.

11. The brake assembly as in claim 10, wherein said opening and the lengthwise direction are oriented transverse to a rotational axis of said shaft.

12. The brake assembly as in claim 9, wherein said axle defines a shaft hole configured to receive an end of said shaft.

13. The brake assembly as in claim 12, where said axle includes mating features within said shaft hole that are configured to engage corresponding mating features of said shaft when said shaft is received within said shaft hole such that said axle rotates with said shaft.

14. The brake assembly as in claim 12, further comprising a locking pin configured to be inserted through said axle and into a portion of said shaft when said shaft is received within said shaft hole.

15. The brake assembly as in claim 7, wherein a profile of said cam surface is configured such that, when said shaft is rotated in a first direction, said pin reciprocates in the lengthwise direction as said pin contacts said cam surface and, when said shaft is rotated in a second direction, said pin engages said cam surface to allow said race to move with said shaft.

16. The brake assembly as in claim 15, wherein, when said shaft is rotated in said first direction, said shaft rotates relative to said race such that no braking force is applied against said shaft via said brake.

17. The brake assembly as in claim 15, wherein:

said profile of said cam surface comprises at least one ramp surface and at least one abutment surface;

said pin contacts said at least one ramp surface when said shaft is rotated in said first direction such that said pin is translated along the lengthwise direction; and said pin engages said at least one abutment surface when said shaft is rotated in said second direction such that said race moves with said shaft.

18. The brake assembly as in claim 17, wherein said at least one abutment surface extends generally perpendicular to a rotational axis of said shaft.

19. The brake assembly as in claim 17, wherein:

said at least one ramp surface comprises a plurality of ramp surfaces and said at least one abutment surface comprises a plurality of abutment surfaces; and said plurality of ramp surfaces and said plurality abutment surfaces are spaced apart along said profile in an alternating arrangement.

20. The brake assembly as in claim 7, wherein:

said race defines an outer brake surface; and said brake member is configured to engage said outer brake surface.

21. The brake assembly as in claim 20, wherein: said outer brake surface is defined along an outer perimeter of said race; and said brake member comprises a band brake that is in contact with said outer brake surface.

22. The brake assembly as in claim 21, wherein:

said band brake has a first free end and a second free end; and said first free end and said second free end are movable towards and away from each other.

23. The brake assembly as in claim 22, wherein a force control mechanism is coupled between said first and second free ends and is configured to move said first free end towards said second free end.

24. The brake assembly of claim 7, wherein:

said cam surface defines a profile comprising opposed ramp surfaces;

said pin cyclically reciprocates between said opposed ramp surfaces with relative rotation between said shaft and said race.

25. The brake assembly of claim 24, wherein said opposed ramp surface are spaced apart circumferentially around said cam surface such that, when said first end of said pin reaches an end of a first ramp surface of said opposed ramp surfaces, said second end of said pin begins to engage a second ramp surface of said opposed ramp surfaces.

* * * * *